US006497085B2

(12) United States Patent
Fukumoto et al.

(10) Patent No.: US 6,497,085 B2
(45) Date of Patent: Dec. 24, 2002

(54) COIN WRAPPING MACHINE

(75) Inventors: Isao Fukumoto, Saitama (JP); Mitsumasa Tsuruda, Saitama (JP); Minguo Wang, Saitama (JP)

(73) Assignee: Laurel Precision Machines Co., Ltd., Osaka (JP)

( * ) Notice: Subject to any disclaimer, the term of this patent is extended or adjusted under 35 U.S.C. 154(b) by 0 days.

(21) Appl. No.: 09/934,090

(22) Filed: Aug. 21, 2001

(65) Prior Publication Data

US 2002/0023416 A1 Feb. 28, 2002

(30) Foreign Application Priority Data

Aug. 30, 2000 (JP) ..... 2000-261186

(51) Int. Cl.[7] ..... B65B 57/20
(52) U.S. Cl. ..... 53/501; 53/498; 53/500
(58) Field of Search ..... 53/212, 498, 500, 53/501; 194/206, 207; 209/539, 551, 567, 568, 569, 576, 577, 587

(56) References Cited

U.S. PATENT DOCUMENTS 3,748,821 A * 7/1973 Hull et al. ..... 53/140
4,123,892 A * 11/1978 Asami ..... 453/31
4,370,990 A * 2/1983 Watanabe ..... 453/32
4,896,481 A * 1/1990 Sentoku et al. ..... 53/212
4,897,984 A * 2/1990 Sentoku et al. ..... 53/212
4,979,357 A 12/1990 Miyamoto
5,499,483 A * 3/1996 Oikawa ..... 53/212

FOREIGN PATENT DOCUMENTS

JP 7-64335 7/1995
JP 10-24909 1/1998

* cited by examiner

*Primary Examiner*—Scott A. Smith
*Assistant Examiner*—Chukwurah Nathaniel
(74) *Attorney, Agent, or Firm*—Cohen, Pontani, Lieberman & Pavane

(57) ABSTRACT

A coin wrapping machine includes a discriminator for discriminating whether or not a coin is acceptable, a denomination of the coin when the coin is acceptable and whether or not the denomination of the coin coincides with that specified and counting coins of the specified denomination, a coin stacking device for stacking coins of the denomination to be wrapped, a reference stacked coin height data memory for storing reference stacked coin height data for each denomination of coins stacked by the coin stacking device, and a coin number discrepancy detecting device including a comparator for comparing a height of stacked coins and the reference stacked coin height data for each denomination stored in the reference stacked coin height data memory, the discriminator being made responsive to inclusion in coins of the specified denomination of new issue coins and past issue circulating coins for discriminating whether each coin is a new issue coin or a past issue circulating coin, determined based on a count made by the discriminator.

20 Claims, 8 Drawing Sheets

COIN WRAPPING MACHINE

BACKGROUND OF THE INVENTION

The present invention relates to a coin wrapping machine and, particularly, to such a machine which can accurately detect whether the number of coins to be wrapped is more than or less than a predetermined number even in the case where new issue coins and past issue circulating coins of the same denomination are wrapped together.

DESCRIPTION OF THE PRIOR ART

Coin wrapping machines are generally constituted so as to discriminate the genuineness and denominations of deposited coins, count the number of coins of the denomination to be wrapped, feed every predetermined number of coins to a coin stacking section, roll-like stack coins, further feed the roll-like stacked coins to a coin wrapping section, hold the stacked coins by three wrapping rollers, rotate the stacked coins held by the wrapping rollers while being supported by a support rod, wind a wrapping film around the stacked coins so that there remain crimping portions above and below the stacked coins, crimp the crimping portions of the wrapping film above and below the stacked coins by moving a pair of an upper crimp claw and a lower crimp claw disposed spaced apart vertically toward each other, and produce a wrapped coin roll.

Therefore, a predetermined number of stacked coins should always be fed from the coin stacking section to the coin wrapping section. However, the number of the stacked coin fed to the coin wrapping section may sometimes be less than the predetermined number, since some of the stacked coins may sometime drop out when the stacked coins are fed from the coin stacking section to the coin wrapping section, or the number of stacked coins fed to the coin wrapping section may sometimes be more than the predetermined number, since for some reason, some of the coins stacked in the coin stacking section remain in the coin stacking section without feeding to the coin wrapping section, so that the remaining coin or coins are fed to the coin wrapping section together with the coins stacked in the coin stacking section in the next coin wrapping operation cycle.

In such cases, the number of coins becomes more than or less than the predetermined number despite the fact that predetermined number of coins have to be wrapped. Japanese Patent Publication No. 7-64335 therefore discloses a coin wrapping machine constituted to calculate the height of the stacked coins based on the amounts of movement of the pair of upper and lower crimp claws when they are moved toward each other in order to crimp the upper and lower end portions of a wrapping film wound around the coins roll-like stacked and transferred to the coin wrapping section and to compare the calculated height with a reference height of stacked coins of the denomination concerned, thereby detecting whether the number of coins to be wrapped is more than or less than the predetermined number.

Further, Japanese Patent Application Laid Open No. 10-24909 discloses a coin wrapping machine provided with a sensor for detecting coins stacked in the coin stacking section and transferred to the coin wrapping section and constituted to calculate the height of the stacked coins based on the time during which the stacked coins are detected by the sensor and the moving speed of the stacked coins and compare the calculated height with a reference height of stacked coins of the denomination concerned, thereby detecting whether the number of coins to be wrapped is more than or less than the predetermined number.

These coin wrapping machines assume that the height of a predetermined number of stacked coins is constant for each denomination and, so long as this assumption is true, can detect whether the number of coins to be wrapped is more than or less than the predetermined number in a desired manner by calculating the height of the stacked coins and comparing it with a reference height of stacked coins of the denomination.

On the other hand, recently, coins of the same denomination as that of past issue circulating coins but having different magnetic properties, surface pattern or the like from that of the past issue circulating coins have been newly issued for the purpose of preventing counterfeiting and the like of coins. In such a case, the diameter and thickness of the new issue coin are normally determined to be equal to those of the past issue circulating coin but the new issue coin often has a different surface pattern from that of the past issue circulating coin. As a result, when a predetermined number of the new issue coins are stacked, the height thereof is often different from the height of the predetermined number of the stacked past issue circulating coins and, therefore, it is impossible for a coin wrapping machine provided with a conventional coin number discrepancy detecting device to accurately detect whether the number of the stacked coins is more than or less than the predetermined number.

For instance, 500 yen coins have been newly issued in Japan in order to prevent coin counterfeiting. When fifty past issue circulating 500 yen coins are stacked, the height thereof is 92.9 mm, whereas when fifty new issue 500 yen coins are stacked, the height thereof is 91.8 mm. Therefore, they are slightly different and it is impossible for a coin wrapping machine provided with a conventional coin number discrepancy detecting device to accurately detect whether the number of the stacked coins is more than or less than the predetermined number.

In addition, although past issue coins are gradually collected and taken out of circulation, new issue coins and past issue circulating coins are used as genuine coins until all past issue circulating coins have been collected. Therefore, since coins to be wrapped include both new issue coins and past issue circulating coins, it is impossible to determine the height of a predetermined number of stacked new issue coins as a reference height of stacked coins and detect whether the number of the stacked coins is more than or less than the predetermined number.

SUMMARY OF THE INVENTION

It is therefore an object of the present invention is to provide a coin wrapping machine which can accurately detect whether the number of coins to be wrapped is more than or less than a predetermined number even in the case where new issue coins and past issue circulating coins of the same denomination are wrapped together.

The above and other objects of the present invention can be accomplished by a coin wrapping machine comprising a denomination specifying means for specifying a denomination of coins to be wrapped, a discriminating and counting means for discriminating whether or not a coin is acceptable, a denomination of the coin when the coin is acceptable and whether or not the denomination of the coin coincides with that specified by the denomination specifying means and counting coins of the denomination specified by the denomination specifying means, a coin stacking means for stacking coins of the denomination to be wrapped, a reference stacked coin height data storing means for storing reference stacked coin height data for each denomination of coins stacked by the coin stacking means, and a coin number discrepancy detecting means including a comparing means for comparing a height of stacked coins and the reference stacked coin height data for each denomination stored in the reference stacked coin height data storing means, the discriminating and counting means being made responsive to inclusion in coins of the denomination specified by the denomination specifying means of new issue coins and past issue circulating coins for discriminating whether each coin is a new issue coin or a past issue circulating coin, and the coin number discrepancy detecting device being made responsive to inclusion in the coins of the denomination specified by the denomination specifying means of new issue coins and past issue circulating coins for causing the comparing means thereof to select the reference stacked coin height to be compared with the height of coins stacked by the coin stacking means in accordance with the number of the new issue coins and the number of the past issue circulating coins determined based on a count made by the discriminating and counting means.

According to the present invention, in the case where coins of the denomination specified by the denomination specifying means include new issue coins and past issue circulating coins, since the reference stacked coin height to be compared with the height of coins stacked by the coin stacking means is selected by the comparing means of the coin number discrepancy detecting device in accordance with the number of the new issue coins and the number of the past issue circulating coins determined based on a count made by the discriminating and counting means, even when the height of a predetermined number of stacked new issue coins is different from the height of the same number of stacked past issue circulating coins, it is possible to reliably wrap the new issue coins and the past issue circulated old coins so as to include the predetermined number of coins.

In a preferred aspect of the present invention, the coin wrapping machine further includes a reference stacked coin height data producing means for producing the reference stacked coin height data in accordance with the number of the new issue coins and the number of the past issue circulating coins determined based on the count made by the discriminating and counting means.

According to this preferred aspect of the present invention, since the coin wrapping machine further includes a reference stacked coin height data producing means for producing the reference stacked coin height data in accordance with the number of the new issue coins and the number of the past issue circulating coins, it is possible to accurately produce the reference stacked coin height data to be compared and accurately detect whether the number of coins is more than or less than a predetermined number by comparing them with the height of the coins stacked by the coin stacking means.

In another preferred aspect of the present invention, the reference stacked coin height data storing means is constituted to store reference stacked coin height data of stacked coins formed by stacking (N−i) new issue coins and i past issue circulating old coins for each case of i=0 to N and the coin wrapping machine further includes a reference stacked coin height data selecting means for selecting, when coins of the denomination specified by the denomination specifying means include new issue coins and past issue circulating coins, reference stacked coin height data from among the reference stacked coin height data stored in the reference stacked coin height data storing means in accordance with the number of the new issue coins and the number of the past issue circulating coins determined based on the count made by the discriminating and counting means and outputting the thus selected reference stacked coin height data to the comparing means.

According to this preferred aspect of the present invention, since the reference stacked coin height data storing means stores reference stacked coin height data of stacked coins formed by stacking (N−i) new issue coins and i past issue circulating old coins for each case of i=0 to N and the coin wrapping machine further includes a reference stacked coin height data selecting means for, when coins of the denomination specified by the denomination specifying means include new issue coins and past issue circulating coins, selecting reference stacked coin height data from among the reference stacked coin height data stored in the reference stacked coin height data storing means in accordance with the number of the new issue coins and the number of the past issue circulating coins determined based on the count made by the discriminating and counting means, and outputting the thus selected reference stacked coin height data to the comparing means, it is possible to accurately select the corresponding reference stacked coin height data, compare them with the height of the coins stacked by the coin stacking means and accurately detect whether the number of coins is more than or less than a predetermined number.

In a further preferred aspect of the present invention, coins of a denomination including the new issue coins and the past issue circulating coins and to be stacked by the coin stacking means are classified into a plurality of groups of a number less than the number of coins to be wrapped in accordance with the number of the new issue coins and the number of the past issue circulating coins, the reference stacked coin height data storing means is constituted to store reference stacked coin height data for each of the plurality of groups, and the reference stacked coin height data selecting means is constituted to classify the coins of a denomination including the new issue coins and the past issue circulating coins and to be stacked by the coin stacking means into a plurality of groups of a number less than the number of coins to be wrapped in accordance with the number of the new issue coins and the number of the past issue circulating coins determined based on the count made by the discriminating and counting means, select the reference stacked coin height data corresponding to each classified group and stored in the reference stacked coin height data storing means and output them to the comparing means.

According to this preferred aspect of the present invention, since coins of a denomination including the new issue coins and the past issue circulating coins and to be stacked by the coin stacking means are classified into a plurality of groups of a number less than the number of coins to be wrapped in accordance with the number of the new issue coins and the number of the past issue circulating coins, the reference stacked coin height data storing means is constituted to store reference stacked coin height data for each of the plurality of groups, and the reference stacked coin height data selecting means is constituted to classify the coins of a denomination including the new issue coins and the past issue circulating coins and to be stacked by the coin stacking means into a plurality of groups of a number less than the number of coins to be wrapped in accordance with the number of the new issue coins and the number of the past issue circulating coins determined based on the count made by the discriminating and counting means, select the reference stacked coin height data corresponding to each classified group and stored in the reference stacked coin height data storing means and output them to the comparing means, even when the height of a predetermined number of stacked new issue coins is different from the height of the same number of stacked past issue circulating coins, it is possible to reliably wrap the new issue coins and the past issue circulated old coins so as to include the predetermined number of coins without need for great memory capacity and in a short calculating time.

In another preferred aspect of the present invention, the coin wrapping machine further includes a reference stacked coin height data correcting means for correcting, when coins of the denomination specified by the denomination specifying means include new issue coins and past issue circulating coins, the reference stacked coin height data stored in the reference stacked coin height data storing means in accordance with the number of the new issue coins and the number of the past issue circulating coins determined based on the count made by the discriminating and counting means, and outputting the thus corrected reference stacked coin height data to the comparing means.

According to this preferred aspect of the present invention, since the reference stacked coin height data stored in the reference stacked coin height data storing means are corrected by the reference stacked coin height data correcting means in accordance with the number of the new issue coins and the number of the past issue circulating coins determined based on the count made by the discriminating and counting means, and the thus corrected reference stacked coin height data are output to the comparing means, even when the height of a predetermined number of stacked new issue coins is different from the height of the same number of stacked past issue circulating coins, it is possible to reliably wrap the new issue coins and the past issue circulated old coins so as to include the predetermined number of coins without need for great memory capacity.

In a further preferred aspect of the present invention, the reference stacked coin height data correcting means is constituted to classify coins of a denomination including the new issue coins and the past issue circulating coins and stacked by the coin stacking means into a plurality of groups of a number less than the number of coins to be wrapped in accordance with the number of the new issue coins and the number of the past issue circulating coins determined based on the count made by the discriminating and counting means, correct the reference stacked coin height data stored in the reference stacked coin height data storing means in accordance with a correction value assigned to each of the groups, and output the thus corrected reference stacked coin height data to the comparing means.

According to this preferred aspect of the present invention, since the reference stacked coin height data correcting means is constituted to classify coins of a denomination including the new issue coins and the past issue circulating coins and stacked by the coin stacking means into a plurality of groups of a number less than the number of coins to be wrapped in accordance with the number of the new issue coins and the number of the past issue circulating coins determined based on the count made by the discriminating and counting means, correct the reference stacked coin height data stored in the reference stacked coin height data storing means in accordance with a correction value assigned to each of the groups, and output the thus corrected reference stacked coin height data to the comparing means, even when the height of a predetermined number of stacked new issue coins is different from the height of the same number of stacked past issue circulating coins, it is possible to reliably wrap the new issue coins and the past issue circulated old coins so as to include the predetermined number of coins without need for great memory capacity and in a a short calculating time.

In a further preferred aspect of the present invention, the reference stacked coin height data storing means is constituted to store stacked coin height data produced by stacking the wrapped number of the past issue circulating coins as reference stacked coin height data of coins of a denomination including the new issue coins and the past issue circulating coins.

In another preferred aspect of the present invention, the reference stacked coin height data storing means is constituted to store stacked coin height data produced by stacking the wrapped number of the new issue coins as reference stacked coin height data of coins of denomination including the new issue coins and the past issue circulating coins.

In another preferred aspect of the present invention, the reference stacked coin height data storing means is constituted to store an average value of stacked coin height data produced by stacking the wrapped number of the new issue coins and stacked coin height data produced by stacking the wrapped number of the past issue circulating coins as reference stacked coin height data of coins of a denomination including the new issue coins and the past issue circulating coins.

The above and other objects of the present invention can be also accomplished by a coin wrapping machine comprising a denomination specifying means for specifying a denomination of coins to be wrapped, a discriminating and counting means for discriminating whether or not a coin is acceptable, a denomination of the coin when the coin is acceptable and whether or not the denomination of the coin coincides with that specified by the denomination specifying means and counting coins of the denomination specified by the denomination specifying means, a coin stacking means for stacking coins of the denomination to be wrapped, a reference stacked coin height data storing means for storing reference stacked coin height data for each denomination of coins stacked by the coin stacking means, a detected stacked coin height data storing means for storing a height of coins stacked by the coin stacking means, a detected stacked coin height data correcting means for correcting the detected stacked coin height data stored in the detected stacked coin height data storing means, and a coin number discrepancy detecting device including a comparing means for comparing the height of coins stacked by the coin stacking means and stored in the detected stacked coin height data storing means and the reference stacked coin height data for each denomination stored in the reference stacked coin height data storing means, the discriminating and counting means being made responsive to inclusion in coins of the denomination specified by the denomination specifying means of new issue coins and past issue circulating coins for discriminating whether the coin is a new issue coin or a past issue circulating coin and the detected stacked coin height data correcting means being made responsive to inclusion in the coins of the denomination specified by the denomination specifying means for correcting the detected stacked coin height data stored in the detected stacked coin height data storing means in accordance with the number of the new issue coins and the number of the past issue circulating coins determined based on a count made by the discriminating and counting means, and outputting the thus corrected detected stacked coin height data to the comparing means.

According to the present invention, in the case where coins of the denomination specified by the denomination specifying means include new issue coins and past issue circulating coins, since the detected stacked coin height data correcting means is constituted to correct the detected stacked coin height data stored in the detected stacked coin height data storing means in accordance with the number of the new issue coins and the number of the past issue circulating coins determined based on the count made by the discriminating and counting means, and output the thus corrected detected stacked coin height data to the comparing means, even when the height of a predetermined number of stacked new issue coins is different from the height of the same number of stacked past issue circulating coins, it is possible to reliably wrap the new issue coins and the past issue circulated old coins so as to include the predetermined number of coins.

In a preferred aspect of the present invention, the detected stacked coin height data correcting means is constituted to classify the coins of a denomination including the new issue coins and the past issue circulating coins and stacked by the coin stacking means into a plurality of groups of a number less than the number of coins to be wrapped in accordance with the number of the new issue coins and the number of the past issue circulating coins determined based on the count made by the discriminating and counting means, correct the detected stacked coin height data stored in the detected stacked coin height data storing means in accordance with a correction value assigned to each of the groups, and output the thus corrected reference stacked coin height data to the comparing means.

According to this preferred aspect of the present invention, since the detected stacked coin height data correcting means is constituted to classify the coins of a denomination including the new issue coins and the past issue circulating coins and stacked by the coin stacking means into a plurality of groups of a number less than the number of coins to be wrapped in accordance with the number of the new issue coins and the number of the past issue circulating coins determined based on the count made by the discriminating and counting means, correct the detected stacked coin height data stored in the detected stacked coin height data storing means in accordance with a correction value assigned to each of the groups, and output the thus corrected reference stacked coin height data to the comparing means, even when the height of a predetermined number of stacked new issue coins is different from the height of the same number of stacked past issue circulating coins, it is possible to reliably wrap the new issue coins and the past issue circulated old coins so as to include the predetermined number of coins without need for great memory capacity and in a short calculating time.

In a further preferred aspect of the present invention, the detected stacked coin height data correcting means is constituted to store stacked coin height data produced by stacking the wrapped number of the past issue circulating coins as reference stacked coin height data of coins of a denomination including the new issue coins and the past issue circulating coins.

In a further preferred aspect of the present invention, the detected stacked coin height data correcting means is constituted to store stacked coin height data produced by stacking the wrapped number of the new issue coins as reference stacked coin height data of coins of a denomination including the new issue coins and the past issue circulating coins.

In a further preferred aspect of the present invention, the detected stacked coin height data correcting means is constituted to store an average value of stacked coin height data produced by stacking the wrapped number of the new issue coins and stacked coin height data produced by stacking the wrapped number of the past issue circulating coins as reference stacked coin height data of coins of a denomination including the new issue coins and the past issue circulating coins.

The above and other objects and features of the present invention will become apparent from the following description made with reference to the accompanying drawings.

DESCRIPTION OF THE PREFERRED EMBODIMENT

Figure 1:
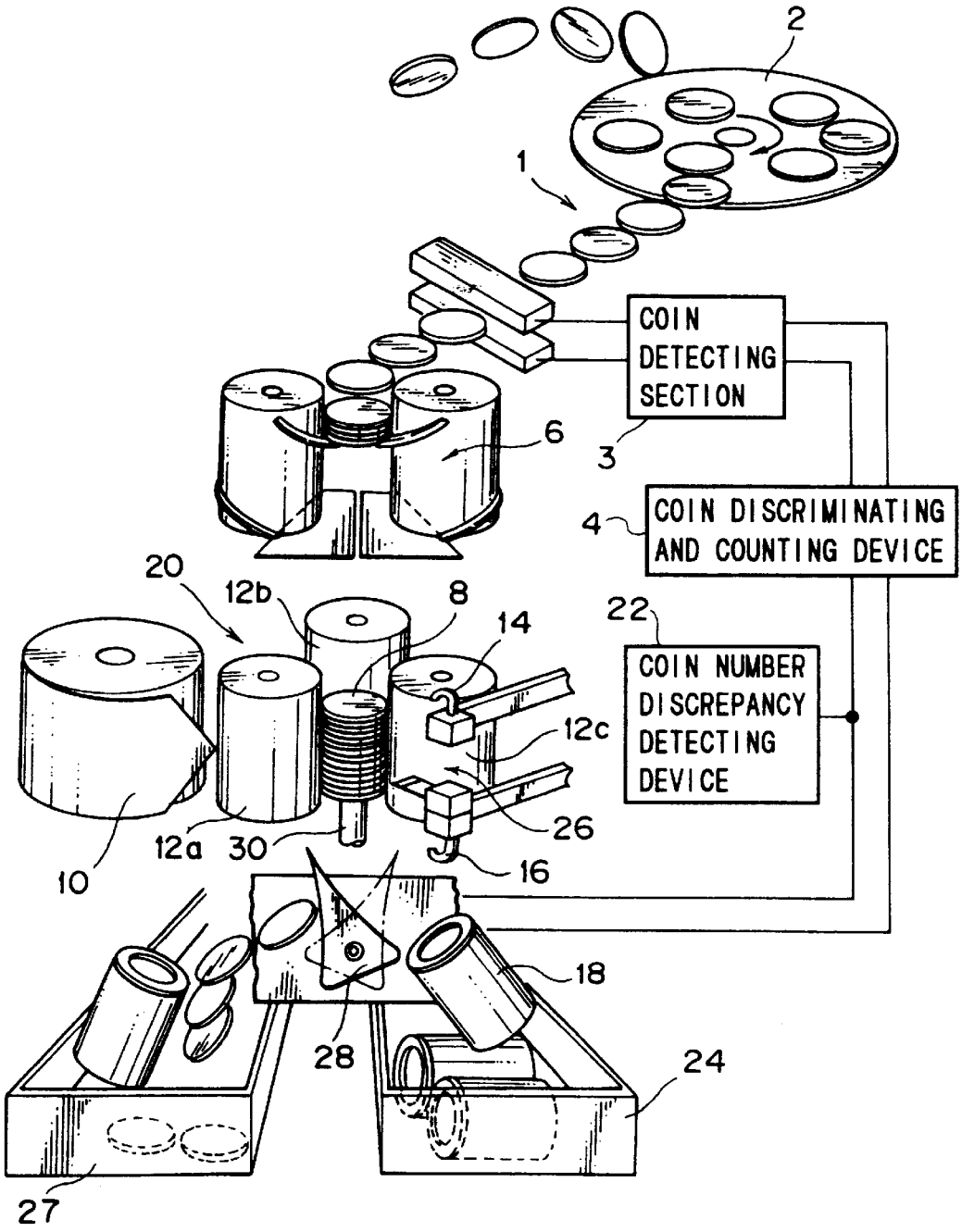
FIG. 1 is a schematic perspective view showing the internal mechanism of a coin wrapping machine which is a preferred embodiment of the present invention.

As shown in FIG. 1, a coin wrapping machine which is an embodiment of the present invention includes a rotatable disk 2 for receiving coins deposited into the coin wrapping machine on the upper surface thereof and feeding them out one by one into a coin passage 1, a coin detecting section 3 provided in the coin passage 1 for detecting magnetic properties of coins and optical properties of coins such as diameters, surface patterns, side surface patterns and the like, a coin discriminating and counting device 4 for discriminating the genuineness, denominations and the like of coins based on the magnetic properties and the optical properties of coins detected by the coin detecting section 3 and counting coins, a coin stacking section 6 for stacking a predetermined number of coins to be wrapped, a coin wrapping section 20 provided with three wrapping roller 12*a*, 12*b*, 12*c* for winding a wrapping film 10 formed of paper, plastic or the like around stacked coins 8 roll-like stacked in the coin stacking section 6 and an upper crimp claw 14 and lower crimp claw 16 for crimping upper and lower end portions of the wrapping film 10 and adapted for producing a wrapped coin roll 18 containing a predetermined number of coins wrapped by the wrapping film 10, a coin number discrepancy detecting device 22 for detecting whether or not a predetermined number of stacked coins 8 are wrapped based on amounts of relative movement of the upper crimp claw 14 and the lower crimp claw 16 during a crimping operation, and a gate member 28 for feeding a wrapped coin roll 18 to a wrapped coin roll collecting box 24 when a predetermined number of stacked coins 8 have been wrapped to produce the wrapped coin roll 18 and cutting the wrapping film 10 wound around the coins by a cutting device 26 when a predetermined number of stacked coins 8 have not been wrapped to feed coins into a coin collecting box 27.

In the thus constituted coin wrapping machine, magnetic properties and optical properties such as diameters, surface patterns, side surface patterns of deposited coins and the like are detected by the coin detecting section 2. Then, the genuineness and the denominations of the coins are discriminated and the number thereof is counted by the coin discriminating and counting device 4. Further, only coins of the denomination to be wrapped are sorted from coins of other denominations by a coin sorting device (not shown) and every predetermined number of coins is fed to the coin stacking section 6.

In the coin stacking section 6, coins are roll-like stacked in a well-known manner and the roll-like stacked coins 8 are delivered from the coin stacking section 6 onto a coin support post 30. The coins are then lowered together with the coin support post 30 and moved to a wrapping position in the coin wrapping section 20.

Afterward, the stacked coins 8 are rotated by the three wrapping rollers 12*a,* 12*b,* 12*c,* while being held thereby and a wrapping film 10 having a width larger than the height of the stacked coins 8 is fed from a wrapping film feeding means (not shown) and wound around the stacked coins 8.

The upper and lower portions of the wrapping film 10 are crimped by the upper crimp claw 14 and the lower crimp claw 16 and, as described later, the coin number discrepancy detecting device 22 detects whether a predetermined number of coins are wrapped during the crimping operation by the upper crimp claw 14 and the lower crimp claw 16.

The gate member 28 is normally located at a position indicated by a solid line in FIG. 1 and a wrapped coin roll 18 produced by wrapping a predetermined number of coins is collected in the wrapped coin roll collecting box 24.

On the other hand, when the coin number discrepancy detecting device 22 detects that the number of coins is more than or less than a predetermined number and that the predetermined number of coins 8 have not been wrapped, the wrapping film 10 wound around the coins 8 is cut by the cutting device 26 and the gate member 28 is swung to a position indicated by a broken line in FIG. 1 in accordance with a signal from the coin number discrepancy detecting device 22, thereby collecting the coins in the coin collecting box 27 separately from the wrapped coin rolls.

Figure 2:
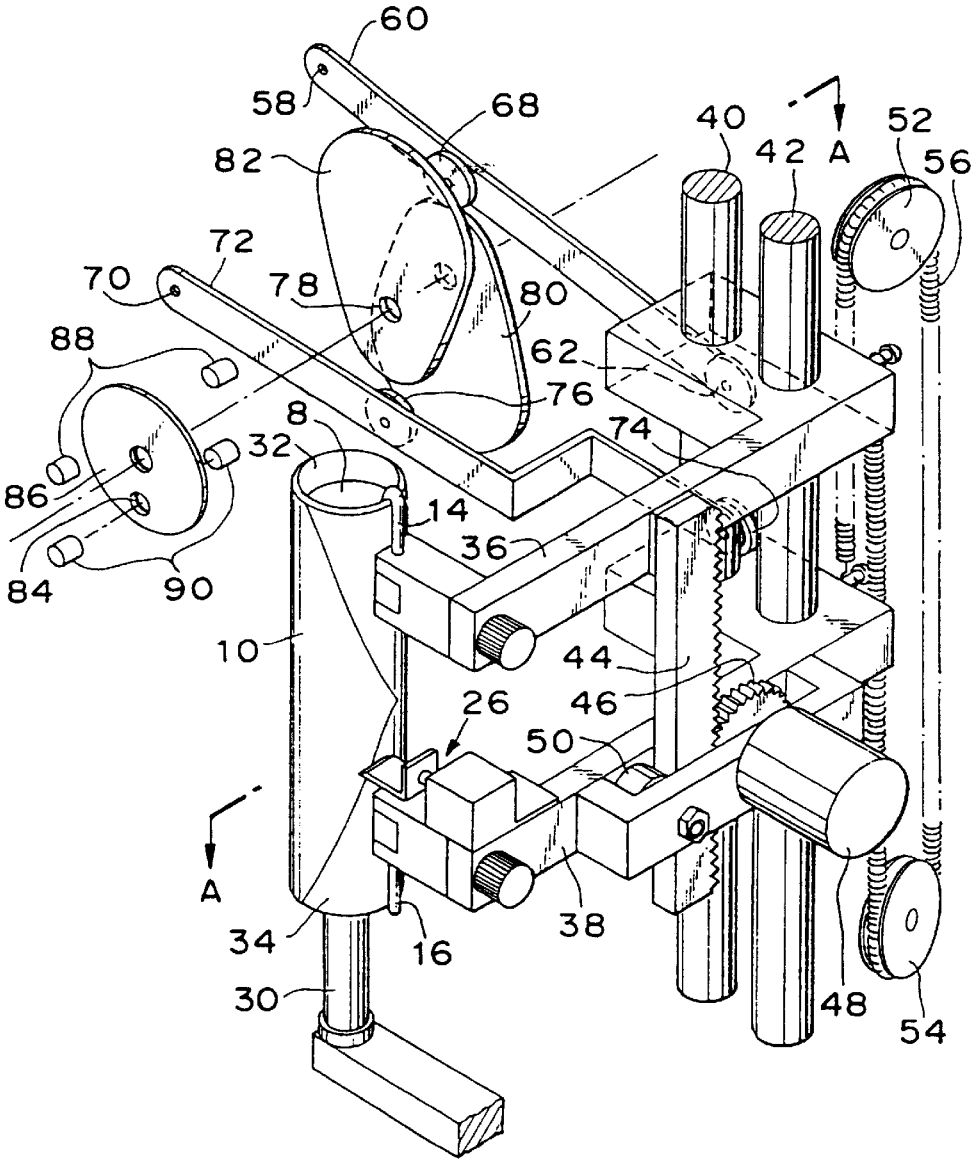
FIG. 2 is a schematic perspective view showing the details of a coin wrapping section of a coin wrapping machine shown in FIG. 1.

FIG. 2 is a schematic perspective view showing the details of a coin wrapping section of the coin wrapping machine shown in FIG. 1.

As shown in FIG. 2, the wrapping film 10 fed from the wrapping film feeding means (not shown) has a width larger than the height of the stacked coins 8 and is wound around the stacked coins 8 by the wrapping rollers 12*a,* 12*b,* 12*c* so that crimp regions 32, 34 remain above and below the stacked coins 8.

The coin wrapping machine is provided with the upper crimp claw 14 and the lower crimp claw 16 for crimping the upper and lower crimp regions 32, 34 of the wrapping film 10 to roll-like wrap the stacked coins 8 and produce a wrapped coin roll 18. The upper crimp claw 14 is fixed to one end portion of an upper crimp claw arm 36 extending horizontally and the lower crimp claw 16 is fixed to one end portion of a lower crimp claw arm 38 extending horizontally.

In the vicinity of the other end portions thereof, the upper crimp claw 14 and the lower crimp claw 16 are supported by guide rods 40, 42 respectively, whereby they can be moved vertically, in other words, they are supported in such a manner that they can be moved toward and apart from each other. The upper crimp claw 14, the lower crimp claw 16 and the guide rod 42 are swingable in the horizontal direction about the guide rod 40 together with arms (not shown) mounted on the guide rod 40 at upper and lower end portions thereof and swingable about the guide rod 40 so that the upper crimp claw 14 and the lower crimp claw 16 can be moved horizontally to predetermined positions in accordance with diameters of coins to be wrapped.

The coin number discrepancy detecting device 22 is constituted to detect whether or not a predetermined number of coins are wrapped by detecting the relative travel distances that the upper crimp claw 14 and the lower crimp claw 16 moved.

A rack 44 extending vertically is fixed to the upper crimp claw arm 36 on which the upper crimp claw 14 is mounted and a pinion 46 engageable with the rack 44 is rotatably mounted on the lower crimp claw arm 38 to which the lower crimp claw 16 is fixed, thereby forming a rack and pinion mechanism. An absolute rotary encoder 48 is connected to the pinion 46. The reference numeral 50 designates a guide roller for guiding the rack 44, thereby ensuring engagement between the rack 44 and the pinion 46.

The upper crimp claw arm 36 and the lower crimp claw arm 38 are connected by a spring 56 engaged with pulleys 52, 54 and the upper crimp claw arm 36 is biased downwardly and the lower crimp claw arm 38 is biased upwardly by the spring 56.

A roller 62 abuts against the lower surface of the upper crimp claw arm 36 in the vicinity of the guide rods 40, 42, the roller 62 being secured to an upper swing arm 60 at the tip end portion thereof that is swingable about a shaft 58 in the vertical plane, and a cam follower 68 is rotatably mounted on the upper swing arm 60 at substantially the central position thereof between the shaft 58 and the roller 62. On the other hand, a roller 74 abuts against the upper surface of the lower crimp claw arm 38 in the vicinity of the guide rods 40, 42, the roller 74 being secured to a lower swing arm 72 at the tip end portion thereof that is swingable about a shaft 70 in the vertical plane, and a cam follower 76 is rotatably mounted on the lower swing arm 72 at substantially the central position thereof between the shaft 70 and the roller 74.

The cam follower 68 of the upper swing arm 60 abuts against the cam lobe of a first cam 80 rotatable about a cam shaft 78 and the cam follower 76 of the lower swing arm 72 abuts against the cam lobe of a second cam 82 rotatable about the cam shaft 78. The first cam 80 and the second cam 82 are connected to each other so as to be rotated together.

The profiles of the first cam 80 and the second cam 82 are respectively determined so that each has a cam lobe farthest from the cam shaft 78 and a cam lobe closest to the cam shaft 78 at positions spaced by 180 degrees, and that when the cam follower 68 of the upper swing arm 60 and the cam follower of the lower swing arm 72 respectively abut against the cam lobe farthest from the cam shaft 78, the upper crimp claw 14 is positioned at the uppermost position thereof and the lower crimp claw 16 is positioned at the lowermost position thereof, in other words, they are positioned at the retracted positions thereof, while when the cam follower 68 of the upper swing arm 60 and the cam follower 76 of the lower swing arm 72 respectively abut against the cam lobe closest to the cam shaft 78, the upper crimp claw 14 is positioned at the lowermost position thereof and the lower crimp claw 16 is positioned at the uppermost position thereof.

The lowermost position of the upper crimp claw 14 and the uppermost position of the lower crimp claw 16 are set in such a manner that the former can be lower than and the latter can be higher than the positions where the upper crimp claw 14 and the lower crimp claw 16 hold the stacked coins 8 therebetween when a predetermined number of thinnest coins are to be wrapped.

More specifically, when the upper crimp claw 14 and the lower crimp claw 16 hold the stacked coins 8 therebetween, in other words, when the upper crimp claw 14 and the lower crimp claw 16 have reached their crimp positions, in normal situations, the upper crimp claw 14 cannot be lowered any further and the lower crimp claw 16 cannot be raised any further. However, in the case where one of the upper crimp claw 14 and the lower crimp claw 16 has not moved to the predetermined position thereof for some reason, the other crimp claw is further moved until the upper crimp claw 14 and the lower crimp claw 16 can hold the stacked coins 8 therebetween, whereby it is possible to detect any discrepancy in the number of stacked coins without fail.

Accordingly, in normal situations, the upper crimp claw 14 abuts against the upper surface of the uppermost coin of the stacked coins 8 to be wrapped and the lower crimp claw 16 abuts against the lower surface of the lowermost coin of the stacked coins 8 to be wrapped, even before the cam follower 68 of the upper swing arm 60 and the cam follower 76 of the lower swing arm 72 respectively come into contact with the cam lobe closest to the cam shaft 78. As a result, the upper crimp claw 14 and the lower crimp claw 16, and the upper crimp claw arm 36 and the lower crimp claw arm 38 do not move any more. Then, when the first cam 80 and the second cam 82 are further rotated, the roller 62 departs from the lower surface of the upper crimp claw arm 36, while the cam follower 68 of the upper swing arm 60 abuts against the cam lobe of the first cam 80. On the other hand, the cam follower 76 of the lower swing arm 72 departs from the cam lobe of the second cam 82, while the roller 74 abuts against the upper surface of the lower crimp claw arm 38. Thus, the engagement between the first cam 80 and the upper crimp claw arm 36 via the upper swing arm 60 and the engagement between the second cam 82 and the lower crimp claw arm 38 via the lower swing arm 72 are released.

As shown schematically in FIG. 2, a disk 86 formed with a light transmission hole 84 and rotatable together with the first cam 80 and the second cam 82 is provided coaxially with the cam shaft 78 and photo sensors 88, 90, each including a light emitting element and a light receiving element, are disposed to confront the disk 86.

The photo sensor 88 is disposed so that light emitted from the light emitting element thereof can be received via the light transmission hole 84 by the light receiving element thereof when the cam follower 68 of the upper swing arm 60 and the cam follower 76 of the lower swing arm 72 respectively abut against the cam lobes of the first cam 80 and the second cam 82 farthest from the cam shaft 78, and the photo sensor 90 is disposed so that light emitted from the light emitting element thereof can be received via the light transmission hole 84 by the light receiving element thereof when the cam follower 68 of the upper swing arm 60 abuts against the cam lobe of the first cam 80 closest to the cam shaft 78. The photo sensors 88, 90 are disposed so as to be spaced from each other by 180 degrees with respect to the rotating direction of the disk 86.

Therefore, the photo sensor 88 can detect that the upper crimp claw 14 and the lower crimp claw 16 are positioned at their retracted positions. Moreover, when the cam follower 68 of the upper swing arm 60 is on the cam lobe of the first cam 80 closest to the cam shaft 78, since the upper crimp claw 14 is then positioned so as to abut against the upper surface of the uppermost coin of the stacked coins 8 to be wrapped and the lower crimp claw 16 is positioned so as to abut against the lower surface of the lowermost coin of the stacked coins 8 to be wrapped, in other words, they are positioned at their crimp positions, it is possible for the photo sensor 90 to detect that the upper crimp claw 14 and the lower crimp claw 16 are positioned at their crimp positions.

As described above, when the first cam 80 and the second cam 82 are rotated by one revolution for wrapping a roll of the stacked coins 8, the upper crimp claw 14 and the lower crimp claw 16 are respectively moved from their retracted positions to their crimp positions and returned to their retracted positions and the upper crimp claw arm 36 and the lower crimp claw arm 38 are moved in the vertical direction in accordance with the movement of the upper crimp claw 14 and the lower crimp claw 16.

As a result, the pinion 46 rotatably mounted on the lower crimp claw arm 38 is rotated by the rack 44 fixed to the upper crimp claw arm 36 by a distance corresponding to the sum of the travel distances of the upper crimp claw 14 and the lower crimp claw 16 in the vertical direction.

Since the absolute rotary encoder 48 connected with the pinion 46 can output coded absolute position data of a predetermined number of bits in accordance with the position of rotation, it is possible to detect the travel distances of the upper crimp claw 14 and the lower crimp claw 16 in the vertical direction based upon the absolute position data output from the rotary encoder 48. For instance, in the case where a pinion 46 of a diameter of 24 mm and a rotary encoder 48 of 8 bits are employed, it is possible to obtain the absolute position data with a resolution of 0.29 mm.

Figure 3:
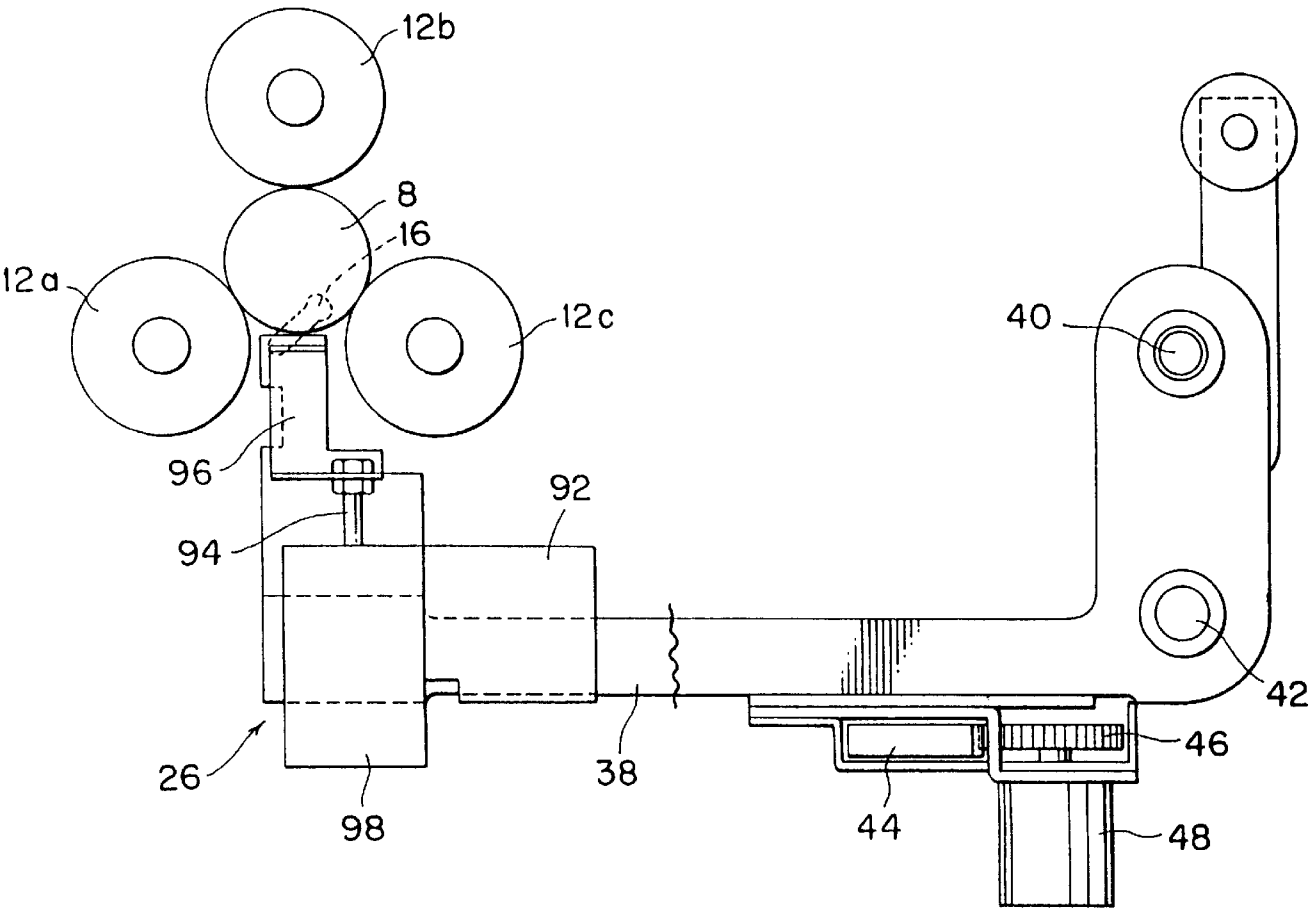
FIG. 3 is a schematic cross sectional view taken along line A—A in FIG. 2.

FIG. 3 is a schematic cross sectional view taken along line A—A in FIG. 2.

As shown in FIG. 3, the cutting device 26 is mounted on the lower crimp claw arm 38 at the end portion thereof in the vicinity of a wrapping position by a solenoid attachment plate 92. The cutting device 26 is comprised of a solenoid 98, a cutter 96 for cutting the wrapping film 10 wound around the stacked coins 8, which is attached to the rod portion 94 of the solenoid 98 and is movable in the horizontal direction by the solenoid 98.

When the coin number discrepancy device 22 detects that the number of coins wrapped is less than or more than the predetermined number and the predetermined number of coins have not been wrapped, the coin number discrepancy device 22 outputs a coin number discrepancy signal to a control unit (not shown in FIG. 3) and the control unit outputs a solenoid advance signal in accordance with the input coin number discrepancy signal, thereby driving and advancing the solenoid 98. As a result, the cutter 96 attached to the rod portion 94 is advanced in the horizontal direction toward the wrapped stacked coins 8 by the solenoid 98 and is pressed against the side of the wrapped coins which are being rotated by the wrapping rollers 12*a*, 12*b*, 12*c*, thereby cutting the wrapping film 10 wound around the stacked coins 8. After a certain time period has passed, the control unit outputs a solenoid retraction signal, thereby causing the solenoid 98 to retract the cutter 96 in the reverse direction and hold it at the retracted position thereof.

Figure 4:
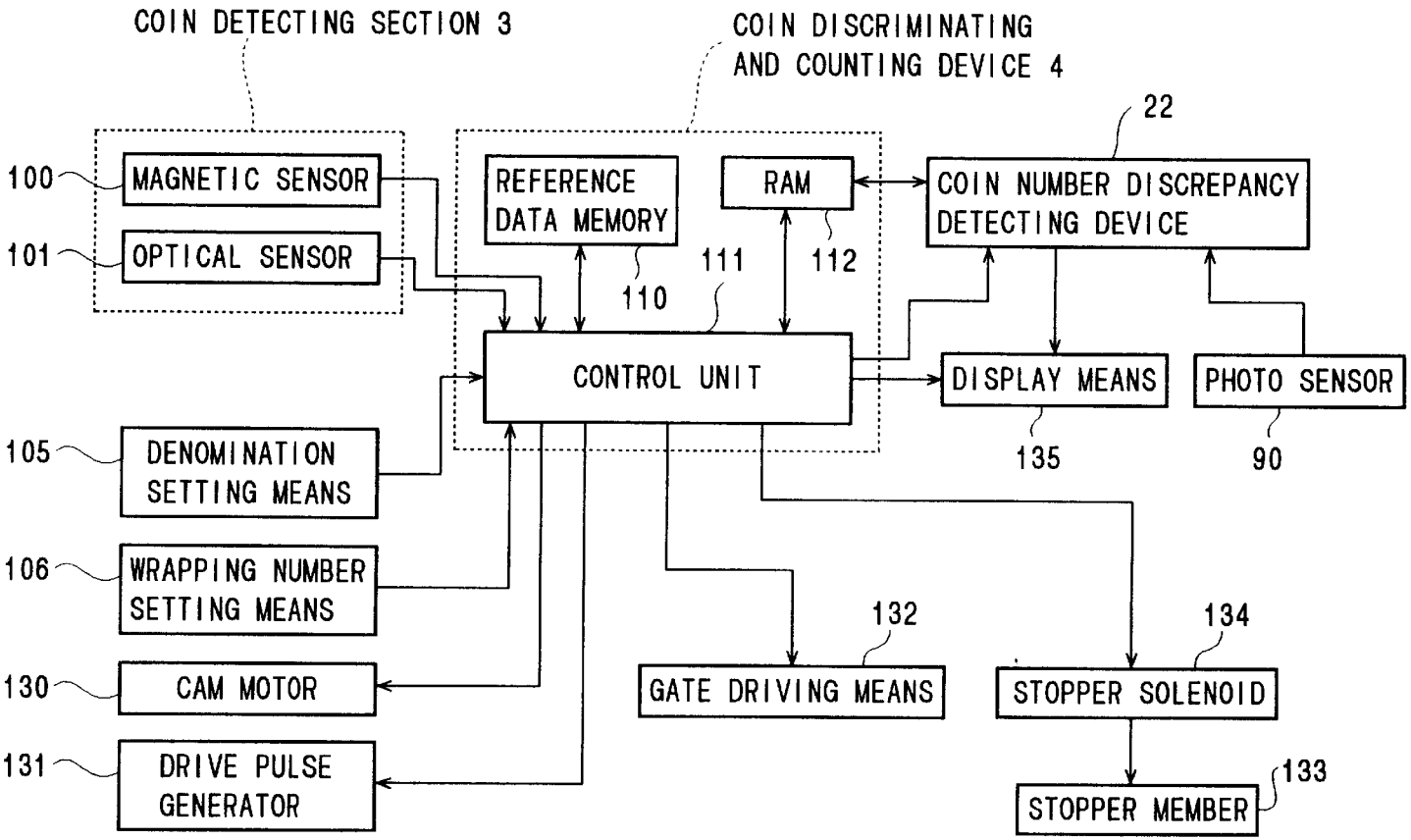
FIG. 4 is a block diagram of a detection system, input system, coin discriminating and counting system, coin number discrepancy detecting system, driving system and display system of a coin wrapping machine which is a preferred embodiment of the present invention.

FIG. 4 is a block diagram of a detection system, input system, coin discriminating and counting system, coin number discrepancy detecting system, driving system and display system of a coin wrapping machine which is a preferred embodiment of the present invention.

As shown in FIG. 4, the detection system of the coin wrapping machine according to this embodiment includes the coin detecting section 3 and the coin detection section 3 includes a magnetic sensor 100 provided in the coin passage 1 for detecting magnetic properties of coins and an optical sensor 101 provided in the coin passage 1 downstream of the magnetic sensor 100 for detecting diameters, surface patterns and side patterns of coins.

As shown in FIG. 4, the detection system of the coin wrapping machine according to this embodiment further includes the photo sensor 90 for detecting the upper crimp claw 14 and the lower crimp claw 16 positioned at their crimp positions.

As shown in FIG. 4, the input system of the coin wrapping machine according to this embodiment includes a denomination setting means 105 for setting a denomination of coins to be wrapped and a wrapping number setting means 106 for setting the number N of coins to be wrapped in a wrapped coin roll 18.

As shown in FIG. 4, the coin discriminating and counting system of the coin wrapping machine according to this embodiment is constituted as the coin discriminating and counting device 4 and the coin discriminating and counting device 4 includes a reference data memory 110 for storing a control program for controlling the entire operation of the coin wrapping machine, and reference magnetic data, reference diameter data, reference surface pattern data and reference side pattern data of coins for each denomination, and a control unit 111 for discriminating based on a magnetic data detection signal whether or not a coin is acceptable, the denomination of the coin when it discriminates the coin to be acceptable, and discriminating, when the discriminated denomination of the coin coincides with the denomination of coins to be wrapped and set by the denomination setting means 105, whether the coin is a new issue coin or a past issue circulating coin of the same denomination as that of newly issued coins and counting the number of coins to be wrapped, and writing the result of the discrimination and the counted number of coins to be wrapped in a RAM 112.

In this embodiment, the reference data memory 110 stores reference magnetic data, reference diameter data, reference surface pattern data and reference side pattern data of new issue coins and reference magnetic data, reference diameter data, reference surface pattern data and reference side pattern data of past issue circulating coins of the same denomination as that of the new issue coins. In the case where there are coins of a denomination including new issue coins and past issue circulating coins of the same denomination as that of the new issue coins among coins to be handled, the reference data memory 110 further stores thickness data of new issue coins and thickness data of past issue circulating coins of the same denomination as that of the new issue coins.

In the case where coins of the denomination specified by the denomination setting means 105 include new issue coins and past issue circulating coins of the same denomination as that of the new issue coins, the control unit 111 is made responsive to the inclusion for writing the counted number of new issue coins, the counted number of past issue circulating coins and the sum of the counted numbers of the new issue coins and the past issue circulating coins in the RAM 112.

As shown in FIG. 4, the coin number discrepancy detecting system of the coin wrapping machine according to this embodiment is constituted as the coin number discrepancy detecting device 22.

Figure 5:
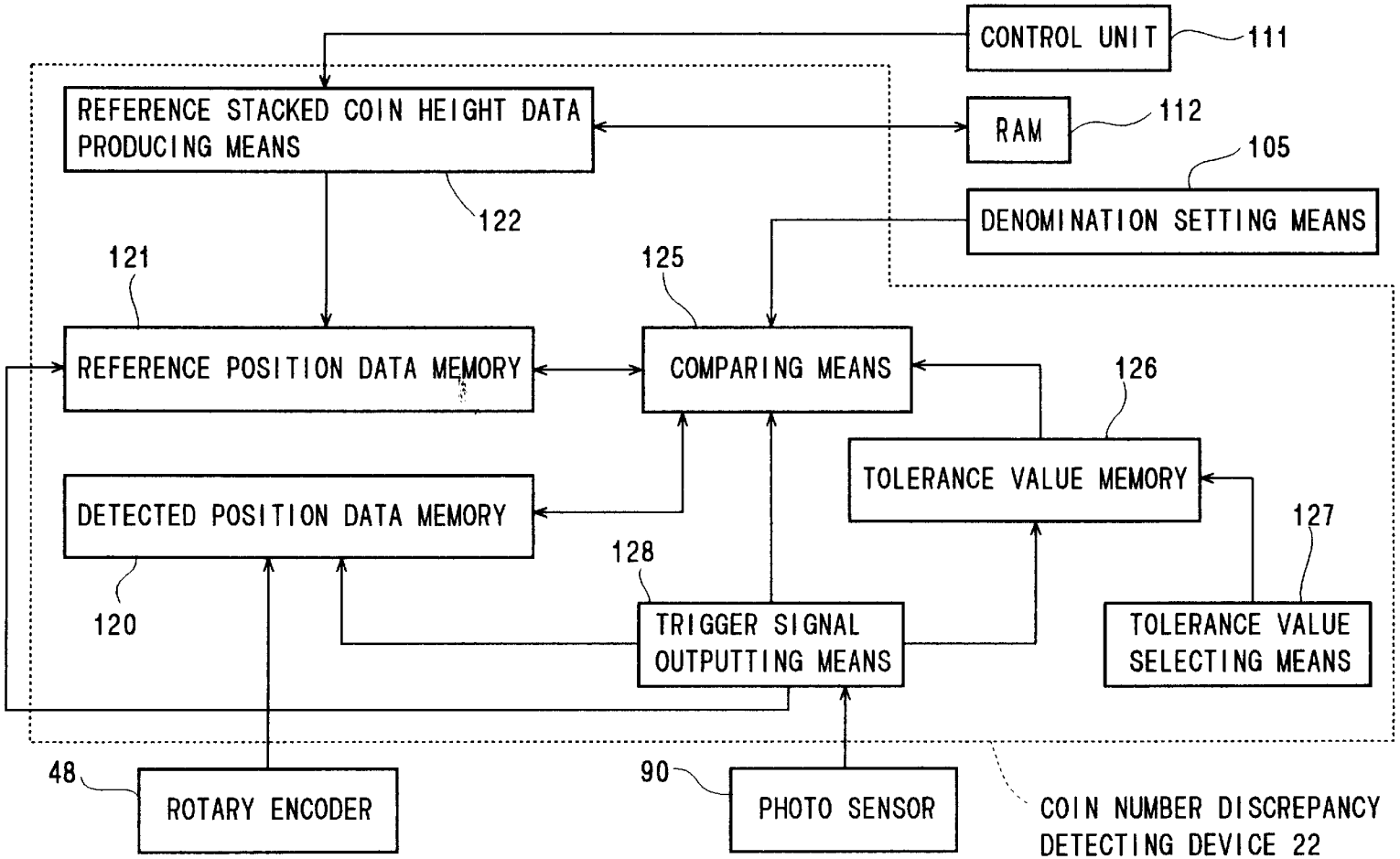
FIG. 5 is a block diagram of a coin number discrepancy detecting device provided in a coin wrapping machine which is a preferred embodiment of the present invention.

FIG. 5 is a block diagram of the coin number discrepancy detecting device 22 provided in the coin wrapping machine which is a preferred embodiment of the present invention.

As shown in FIG. 5, the coin number discrepancy detecting device 22 according to this embodiment includes a detected position data memory 120 for storing absolute position data output from the rotary encoder 48, a reference position data memory 121 for storing reference stacked coin height data for each denomination, which are produced by experimentally calculating the height of stacked coins consisting of a predetermined number of coins for each denomination in advance and converting it to reference absolute position data comparable with the absolute position data of the rotary encoder 48 stored in the detected position data memory 120, and reference stacked coin height data producing means 122 for reading out the count value of new issue coins to be wrapped and the counted number of past issue circulating coins stored in the RAM 112 in the case where coins of the denomination specified by the denomination setting means 105 include new issue coins and past issue circulating coins of the same denomination as that of the new issue coins, producing reference stacked coin height data based on the thus read count value of new issue coins to be wrapped and counted number of past issue circulating coins, and converting them to a data form that can be compared with the absolute position data of the rotary encoder 48.

As shown in FIG. 5, the coin number discrepancy detecting device 22 according to this embodiment further includes comparing means 125 for calculating the difference between absolute position data output from the detected position data memory 120 and reference position data output from the reference position data memory 121, outputting an agreement signal when the difference is equal to or less than a tolerance value and outputting a disagreement signal when the difference exceeds the tolerance value, a tolerance value memory 126 for storing tolerance values based on which discrepancy in the number of coins is judged, a tolerance value selecting means 127 for outputting a selection signal to the tolerance value memory 126 based on an instruction signal from the operator, thereby selecting a tolerance value to be output to the comparing means 125 from among tolerance values stored in the tolerance memory 126 and causing the tolerance value memory 126 to output the thus selected tolerance value to the comparing means 125, and a trigger signal outputting means 128 for outputting, when the photo sensor 90 detects that the upper crimp claw 14 and the lower crimp claw 16 have reached their crimp positions, trigger signals to the detected position data memory 120, the reference position data memory 121 and the tolerance value memory 126, causing the detected position data memory 120 to store absolute position data output from the rotary encoder 48 and to output the absolute position data to the comparing means 125, causing the comparing means 125 to read out reference position data from the reference position data memory 121 and causing the tolerance value memory 126 to output a tolerance value to the comparing means 125, thereby causing the comparing means 125 to start the detection of discrepancy in the number of coins.

As shown in FIG. 4, the drive system of the coin wrapping machine according to this embodiment includes a cam motor 130 for rotating the first cam 80 and the second cam 82, thereby moving the upper crimp claw 14 and the lower crimp claw 16 between the retracted positions and the crimp positions thereof, a drive pulse generator 131 for outputting a solenoid advance signal or a solenoid retraction signal in accordance with disagreement signals output from the comparing means 125, thereby advancing or retracting the cutter 96 mounted on the tip end portion of the rod portion 94, a gate driving means 132 for swinging the gate member 28 between a reference position indicated by a solid line and an open position indicated by a broken line in FIG. 1 and outputting a drive signal for swinging the gate member 28 so that when a predetermined number of coins have been wrapped to produce a wrapped coin roll 18, the wrapped coin roll 18 is fed into the wrapped coin roll collecting box 24, whereas when discrepancy in the number of wrapped coins occurs, the coins are fed into the coin collecting box 27, and a stopper solenoid 134 for driving a stopper member 133 provided in the coin passage 1 downstream of the optical sensor 101, thereby projecting it into the coin passage 1.

As shown in FIG. 4, the display system of the coin wrapping machine according to this embodiment includes a display means 135 for displaying whether or not the number of stacked coins 8 to be wrapped coincides with a predetermined number in accordance with the agreement signal or disagreement signal output from the comparing means 125.

In this embodiment, the control unit 111 is constituted to output a drive signal to the stopper solenoid 134 when the counted number of coins of the denomination to be wrapped and written in the RAM 112 has become equal to the number N specified by the wrapping number setting means 106, thereby projecting the stopper member 133 provided downstream of the optical sensor 101 into the coin passage 1 to prevent coins following the Nth coin of the denomination to be wrapped from being transported, and output a drive signal to the cam motor 130.

Further, in this embodiment, in the case where coins of the denomination specified by the denomination setting means 105 include new issue coins and past issue circulating old coins of the same. denomination as that of the new issue coins, the control unit 111 is responsive to the inclusion for outputting a reference stacked coin height data producing signal to the reference stacked coin height data producing means 122 when the counted number of coins to be wrapped and written in the RAM 112 has become equal to the number N specified by the wrapping number setting means 106, and the reference stacked coin height data producing means 122 is constituted to access the RAM 112 to read the counted number of new issue coins to be wrapped and the counted number of past issue circulating old coins to be wrapped when it receives the reference stacked coin height data producing signal, produce reference stacked coin height data based on the read counted number of the new issue coins and counted number of the past issue circulating coins, convert the reference stacked coin height data to a data form that can be compared with the absolute position data of the rotary encoder 48 and output the converted data to the reference position data memory 121 to store the converted data therein.

The coin wrapping machine provided with the thus constituted coin number discrepancy detecting device 22 according to this embodiment wraps coins of a denomination set by the denomination setting means 105 and detects discrepancy in the number of wrapped coins.

The denomination setting means 105 is first operated by the operator to set the denomination of coins to be wrapped and the wrapping number setting means 106 is operated to set the wrapping number of coins, for example, 50.

The denomination set by the denomination setting means 105 is output to the control unit 111 and the comparing means 125 of the coin number discrepancy detecting device 22.

Coins are then deposited into the coin wrapping machine and when a start button (not shown) is operated, the rotatable disk 2 is rotated and coins fed onto the rotatable disk 2 are fed into the coin passage 1 one by one as well known in the art.

When the magnetic sensor 100 detects magnetic properties of a coin, a magnetic data detection signal is output to the control unit 111.

When the magnetic data detection signal is input from the magnetic sensor 100, the control unit 111 reads reference magnetic data of coins for each denomination from the reference data memory 110 and compares them with the magnetic data input from the magnetic sensor 100, thereby discriminating whether or not the coin is acceptable.

When the control unit 111 discriminates that the coin is unacceptable, it writes the discrimination result in the RAM 112.

To the contrary, when the control unit 111 discriminates that the coin is acceptable, it further discriminates the denomination of the coin and whether or not the denomination of the coin coincides with the denomination of coins set by the denomination setting means 105.

When the control unit 111 discriminates that the denomination of the coin does not coincide with the denomination of coins set by the denomination setting means 105, it writes the discriminated denomination of the coin in the RAM 112.

On the other hand, in the case where the control unit 111 discriminates that the denomination of the coin coincides with the denomination of coins set by the denomination setting means 105 and coins of the denomination specified by the denomination setting means 105 include new issue coins and past issue circulating coins of the same denomination as that of the new issue coins, the control unit 111 further discriminates whether the coin is a new issue coin or a past issue circulating coin and writes the result of discrimination in the RAM 112.

The coin is further fed in the coin passage 1 and when an optical data detection signal is input from the optical sensor 101, the control unit 111 reads reference optical data of coins for each denomination such as reference diameter data, reference surface pattern data, side surface pattern data and the like from the reference data memory 110 and compares them with optical data of the coin input from the optical sensor 101, thereby discriminating whether or not the coin is acceptable.

When the control unit 111 discriminates that the coin is unacceptable, it writes the discrimination result in the RAM 112.

To the contrary, when the control unit 111 discriminates that the coin is acceptable, it further discriminates the denomination of the coin based on the optical data and reads the result of discrimination made based on the magnetic data to compare it with the result of discrimination made based on the optical data.

When the denomination of the coin discriminated based on the optical data of the coin and the denomination of the coin discriminated based on the magnetic data and written in the RAM 112 do not coincide with each other, the control unit 111 discriminates that the coin is unacceptable and writes the discrimination result in the RAM 112.

To the contrary, when the denomination of the coin discriminated based on the optical data of the coin and the denomination of the coin discriminated based on the magnetic data and written in the RAM 112 coincide with each other, the control unit 111 further discriminates whether or not the denomination of the coin coincides with the denomination of coins set by the denomination setting means 105.

When the control unit 111 discriminates that the denomination of the coin does not coincide with the denomination of coins set by the denomination setting means 105, it writes the discriminated denomination of the coin in the RAM 112.

On the other hand, in the case where the control unit 111 discriminates that the denomination of the coin coincides with the denomination of coins set by the denomination setting means 105 and coins of the denomination specified by the denomination setting means 105 include new issue coins and past issue circulating coins of the same denomination as that of the new issue coins, the control unit 111 further discriminates based on the optical data of the coin whether the coin is a new issue coin or a past issue circulating coin and compares the discrimination result with the result of discrimination made based on the magnetic data of the coin and written in the RAM 112.

When the result of discrimination made based on the optical data of the coin and the result of discrimination made based on the magnetic data of the coin and written in the RAM 112 do not coincide with each other, the control unit 111 discriminates that the coin is unacceptable and writes the discrimination result in the RAM 112.

To the contrary, when the result of discrimination made based on the optical data of the coin and the result of discrimination made based on the magnetic data of the coin and written in the RAM 112 coincide with each other, the control unit 111 writes the discrimination result in the RAM 112 and increases the number of coins to be wrapped and stored in the RAM 112 by one.

In this manner, it is discriminated whether or not the coin is acceptable and when the coin is acceptable, the denomination of the coin is discriminated and it is discriminated whether or not the denomination of the coin coincides with the denomination of coins set by the denomination setting means 105. In the case where coins of the denomination specified by the denomination setting means 105 include new issue coins and past issue circulating coins of the same denomination as that of the new issue coins, it is further discriminated whether the coin is a new issue coin or a past issue circulating coin. Then, the coin sorting device (not shown) is driven in accordance with the discrimination result, and unacceptable coins and acceptable coins of denominations different from that of coins set by the denomination setting means 105 are separated out by the coin sorting device and collected.

As a result, only coins of the denomination set by the denomination setting means 105 are fed to the coin stacking section and stacked therein.

The discrimination of coins is repeated in this manner and when coins of a number equal to the number N of coins to be wrapped and set by the wrapping number setting means 106 have been detected, the control unit 111 outputs a drive signal to the stopper solenoid 134 and cause it to project the stopper member 133 into the coin passage 1, thereby preventing coins following the Nth coin of the denomination to be wrapped from being transported.

As a result, coins of a number equal to the number N of coins to be wrapped and set by the wrapping number setting means 106 are fed to the coin stacking section 6 and stacked therein.

In the case where coins of the denomination specified by the denomination setting means 105 include new issue coins and past issue circulating old coins of the same denomination as that of the new issue coins, when coins of a number equal to the number N of coins to be wrapped and set by the wrapping number setting means 106 have been detected, the control unit 111 simultaneously outputs a reference stacked coin height data producing signal to the reference stacked coin height data producing means 122.

When the reference stacked coin height data producing means 122 receives the reference stacked coin height data producing signal, it accesses the RAM 112 to read out the counted number of new issue coins to be wrapped and the counted number of past issue circulating coins to be wrapped and produces reference stacked coin height data based on the read counted number of the new issue coins and counted number of the past issue circulating coins.

More specifically, when the reference stacked coin height data producing means 122 accesses the RAM 112 to read out the counted number of new issue coins to be wrapped and the counted number of past issue circulating coins to be wrapped, it further accesses the reference data memory 110 to read out thickness data of the new issue coin to be wrapped and thickness data of the past issue circulating coin of the same denomination as that of the new issue coin and multiplies the respective thickness data by the corresponding number read out from the ram 112, thereby producing reference stacked coin height data. The reference stacked coin height data producing means 122 then converts the thus produced reference stacked coin height data to the data form that can be compared with the absolute position data of the rotary encoder 48 and outputs the converted data to the reference position data memory 121 to store the data therein.

On the other hand, coins 8 stacked in the coin stacking section 6 are delivered onto the coin support post 30 and lowered together with the coin support post 30 to be transferred to the wrapping position in the coin wrapping section 20.

The stacked coins 8 are then held between the three wrapping rollers 12*a,* 12*b,* 12*c* and rotated thereby and a wrapping film having a width lager than the height of the stacked coins 8 is fed by the wrapping film feeding means (not shown) to be wound around the stacked coins 8.

The cam motor 130 is then driven to rotate the first cam 80 and the second cam 82 and the upper crimp claw 14 and the lower crimp claw 16 are moved from the retracted positions thereof to the crimp positions thereof to crimp the upper and lower end portions of the wrapping film 10 wound around the stacked coins 8 by the upper crimp claw 14 and the lower crimp claw 16.

When the photo sensor 90 detects that the upper crimp claw 14 and the lower crimp claw 16 have been moved from retracted positions thereof to the crimp positions thereof, a detection signal is output from the photo sensor 90 to the trigger signal outputting means 128 and the trigger signal outputting means 128 outputs trigger signals to the detected position data memory 120 and the comparing means 125 based on the detection signal input from the photo sensor 90.

When the detected position data memory 120 receives the trigger signal from the trigger signal outputting means 128, it stores absolute position data output from the rotary encoder 48.

On the other hand, when the comparing means 125 receives the trigger signal from the trigger signal outputting means 128, it accesses the detected position data memory 120 to read the absolute position data output from the rotary encoder 48 and accesses the reference position data memory 121 in accordance with a denomination setting signal input from the denomination setting means 105 to read the reference stacked coin height data of the denomination set by the denomination setting means 105.

Further, the comparing means 125 accesses the tolerance value memory 126 to read out a tolerance value. In this embodiment, it is possible for the operator to cause the comparing means 125 to read a desired tolerance value from among tolerance values stored in the tolerance memory 126 by operating the tolerance value selecting means 127.

The comparing means 125 then calculates the difference between the absolute position data read out from the detected position data memory 120 and the reference position data read out from the reference position data memory 121 and judges whether or not the absolute value thereof is equal to or less than the tolerance value input from the tolerance value memory 126.

When the comparing means 125 judges that the absolute value of the difference between the absolute position data and the reference position data is equal to or less than the tolerance value, it outputs an agreement signal to the display means 135, thereby causing it to display a message that the number of the stacked coins 8 to be wrapped coincides with the predetermined number.

On the other hand, when the comparing means 125 judges that the absolute value of the difference between the absolute position data and the reference position data exceeds the tolerance value, it outputs a disagreement signal to the display means 135, thereby causing it to display a message that the number of the stacked coins 8 to be wrapped does not coincide with the predetermined number and outputs an operation signal to the drive pulse generator 131.

When the drive pulse generator 131 receives the operation signal from the comparing means 125, it outputs a solenoid advance signal to the solenoid 98 and drives the solenoid 98, thereby causing it to advance the cutter 96 so as to abut against the side surface of the wrapping film 10 wound around the stacked coins 8 at the wrapping position.

In this embodiment, since the stacked coins 8 around which the wrapping film 10 is wound are held between the wrapping rollers 12*a,* 12*b,* 12*c* and rotated thereby, the wrapping film 10 is cut along the circumference of the stacked coins 8 by the cutter 96.

The comparing means 125 further outputs a drive signal to the gate driving means 132, thereby causing it to swing the gate member 28 to an open position indicated by a broken line in FIG. 1.

As a result, the stack of less than the predetermined number of wrapped coins or more than the predetermined number of wrapped coins is broken up and the coins are guided by the gate member 28 to be collected in the coin collecting box 27.

When a predetermined time period has passed after the solenoid advance signal was output to the solenoid 98, the comparing means outputs an operation signal to the drive pulse generator 131 to cause it to output a solenoid retraction signal to the solenoid 98.

As a result, the solenoid 98 is driven and the cutter 96 is retracted to be returned to the original position thereof.

According to the above described embodiment, in the case where coins to be wrapped include new issue coins and past issue circulating coins, the numbers of the new issue coins and the past issue circulating old coins which have been fed to the coin wrapping section 20 via the coin stacking section 6 based on the magnetic properties of coins detected by the magnetic sensor 100 and the optical properties of coins such as diameters, surface patterns, side surface patterns of coins and the like are counted by the control unit 111 and stored in the RAM 112. The reference stacked coin height data producing means 122 accesses the RAM 112 to read out the number of the new issue coins fed to the coin wrapping section 20 and the number of past issue circulating coins fed to the coin wrapping section 20 and produces reference stacked coin height data in accordance with the read number of the new issue coins and number of the past issue circulating coins. The comparing means 125 compares the reference stacked coin height data produced by the reference stacked coin height data producing means 122 and the absolute position data output from the rotary encoder 48 and stored in the detected position data memory 120 and detects the discrepancy in the number of coins. Therefore, even when new issue coins and past issue circulating coins of the same denomination as that of the new issue coins are wrapped together, it is possible to accurately detect whether the number of coins to be wrapped by the coin wrapping machine is more than or less than a predetermined number.

Further, according to the above described embodiment, in the case where the number of wrapped coins is less than the predetermined number or exceeds the predetermined number, since the wrapping film 10 is cut by the cutter and the coins are reliably collected in the coin collecting box 27, a wrapped coin roll formed by wrapping less than the predetermined number of wrapped coins or more than the predetermined number of wrapped coins can be reliably separated from wrapped coin rolls formed by wrapping a predetermined number of coins.

Figure 6:
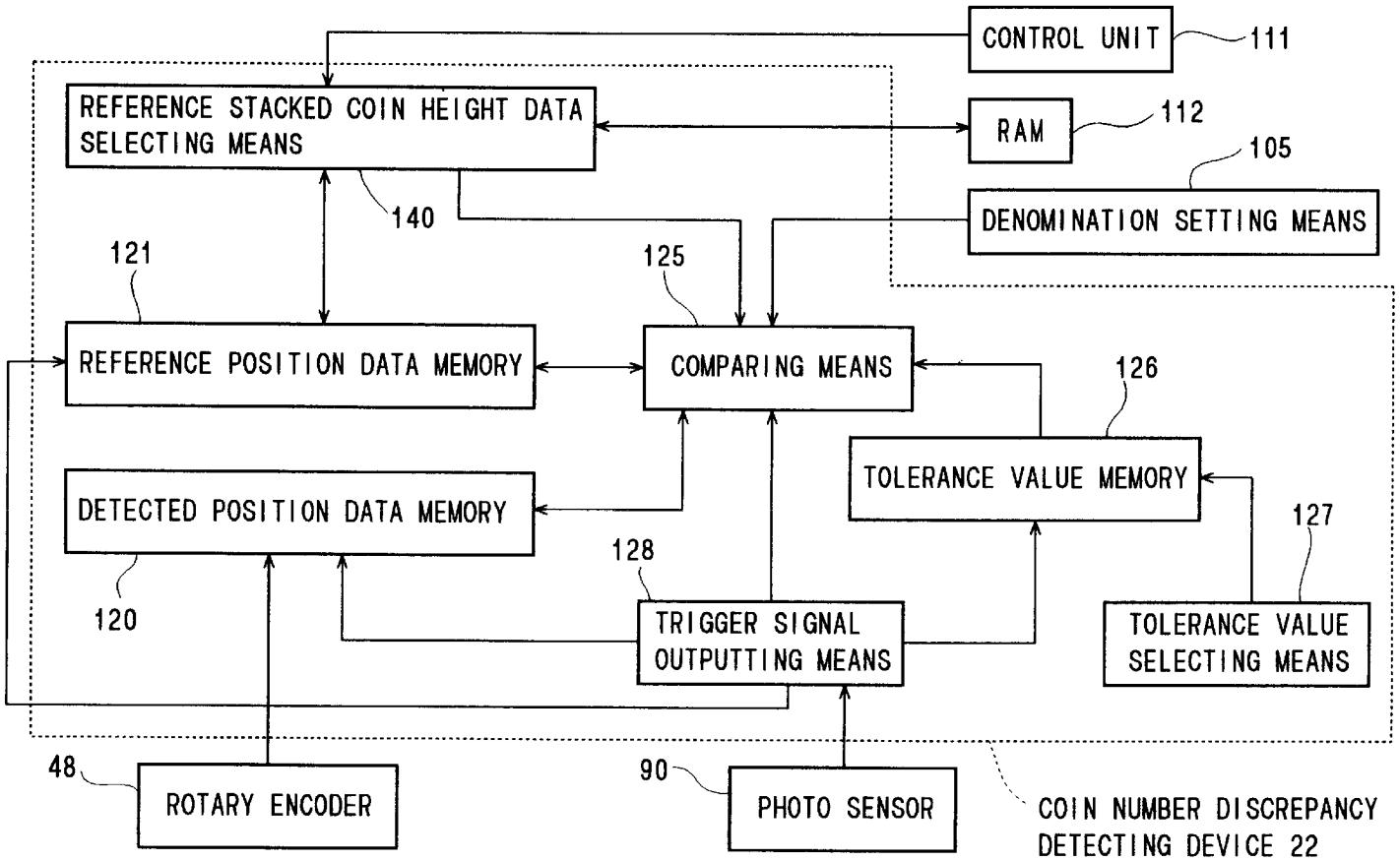
FIG. 6 is a block diagram of a coin number discrepancy detecting device provided in a coin wrapping machine which is another preferred embodiment of the present invention.

FIG. 6 is a block diagram of a coin number discrepancy detecting device 22 provided in a coin wrapping machine which is another preferred embodiment of the present invention.

As shown in FIG. 6, in this embodiment, the coin number discrepancy detecting device 22 includes, instead of the reference stacked coin height data producing means 122 for producing reference stacked coin height data in accordance with the number of new issue coins fed to the coin wrapping section 20 and the number of past issue circulating old coins fed to the coin wrapping section 20, a reference stacked coin height data selecting means 140 for selecting, in accordance with the number of new issue coins fed to the coin wrapping section 20 and the number of past issue circulating old coins fed to the coin wrapping section 20, corresponding reference stacked coin height data from among reference stacked coin height data stored in the reference position data memory 121 and outputting them to the comparing means 125 and has the same configuration as that in the embodiment shown in FIG. 5 except that (N+1) kinds of reference stacked coin height data are produced in accordance with the number of new issue coins and past issue circulating coins and stored in the reference position data memory 121, where N is the wrapping number set by the wrapping number setting means 106.

More specifically, reference stacked coin height data of stacked coin 8 formed by stacking (N−i) new issue coins and i past issue circulating old coins are experimentally produced in advance for each case of i=0 to N and stored in the reference position data memory 121 and the reference stacked coin height data selecting means 140 is constituted to access the RAM 112 to read the number of new issue coins fed to the coin wrapping section 20 and the number of past issue circulating old coins fed to the coin wrapping section 20, which were counted by the control unit 111, select, in accordance with the thus read number of new issue coins and the number of past issue circulating old coins, corresponding reference stacked coin height data from among reference stacked coin height data stored in the reference position data memory 121 and output them to the comparing means 125.

In the case where coins of the denomination specified by the denomination setting means 105 include new issue coins and past issue circulating coins of the same denomination as that of the new issue coins, when the control unit 111 has detected coins of a number equal to the number N of coins to be wrapped set by the wrapping number setting means 106, it immediately outputs a reference stacked coin height data selection signal to the reference stacked coin height data selecting means 140.

When the reference stacked coin height data selecting means 140 receives the reference stacked coin height data selection signal, it accesses the RAM 112 to read the counted number of new issue coins to be wrapped and the number of past issue circulating coins to be wrapped and selects, in accordance with the thus read number of new issue coins and the number of past issue circulating old coins, corresponding reference stacked coin height data from among reference stacked coin height data stored in the reference position data memory 121 to output them to the comparing means 125.

When the trigger signal is input from the trigger signal outputting means 128, the comparing means 125 accesses the detected position data memory 120 to read the absolute position data output from the rotary encoder 48, accesses the tolerance value memory 126 to read the tolerance value, calculates the difference between the absolute position data read out from the detected position data memory 120 and the reference stacked coin height data input from the reference stacked coin height data selecting means 140, namely, the reference position data, and judges whether or not the absolute value of the difference is equal to or less than the tolerance value input from the tolerance value memory 126.

When the comparing means 125 judges that the absolute value of the difference between the absolute position data and the reference position data is equal to or less than the tolerance value, it outputs an agreement signal to the display means 135, thereby causing it to display a message that the number of the stacked coins 8 to be wrapped coincides with the predetermined number.

On the other hand, when the comparing means 125 judges that the absolute value of the difference between the absolute position data and the reference position data exceeds the tolerance value, it outputs a disagreement signal to the display means 135, thereby causing it to display a message that the number of the stacked coins 8 to be wrapped does not coincide with the predetermined number and simultaneously outputs an operation signal to the drive pulse generator 131.

When the drive pulse generator 131 receives the operation signal from the comparing means 125, it outputs a solenoid advance signal to the solenoid 98 and drives the solenoid 98 to cause it to advance the cutter 96 so as to abut against the side surface of the wrapping film 10 wound around the stacked coins 8 at the wrapping position, whereby the wrapping film 10 is cut along the circumference thereof by the cutter 96.

The comparing means 125 further outputs a drive signal to the gate driving means 132, thereby causing it to swing the gate member 28 to an open position indicated by a broken line in FIG. 1.

As a result, the stack formed of less than the predetermined number of wrapped coins or more than the predetermined number of wrapped coins is broken up and the coins are guided by the gate member 28 to be collected in the coin collecting box 27.

When a predetermined time period has passed after the solenoid advance signal was output to the solenoid 98, the comparing means outputs an operation signal to the drive pulse generator 131 to cause it to output a solenoid retraction signal to the solenoid 98.

As a result, the solenoid 98 is driven and the cutter 96 is retracted to be returned to the original position thereof.

According to the above described embodiment, in the case where the number of coins to be wrapped is N and coins to be wrapped include new issue coins and past issue circulating coins, the reference stacked coin height data of stacked coin 8 formed by stacking (N−i) new issue coins and i past issue circulating old coins are experimentally produced in advance for each case of i=0 to N and stored in the reference position data memory 121. The numbers of the new issue coins and the past issue circulating old coins which have been fed to the coin wrapping section 20 via the coin stacking section 6 based on the magnetic properties of coins detected by the magnetic sensor 100 and the optical properties of coins such as diameters, surface patterns, side surface patterns of coins and the like are counted by the control unit 111 and stored in the RAM 112. The reference stacked coin height data selecting means 140 accesses the RAM 112 to read the counted numbers of new issue coins and past issue circulating coins fed to the coin wrapping section 20 and reads, in accordance with the thus read number of new issue coins and the number of past issue circulating old coins, corresponding reference stacked coin height data from among reference stacked coin height data stored in the reference position data memory 121 to output them to the comparing means 125 and the comparing means 125 detects discrepancy in the number of coins fed to the coin wrapping section 20. Therefore, even when new issue coins and past issue circulating coins of the same denomination as that of the new issue coins are wrapped together, it is possible to accurately detect whether the number of coins to be wrapped by the coin wrapping machine is more than or less than a predetermined number.

Figure 7:
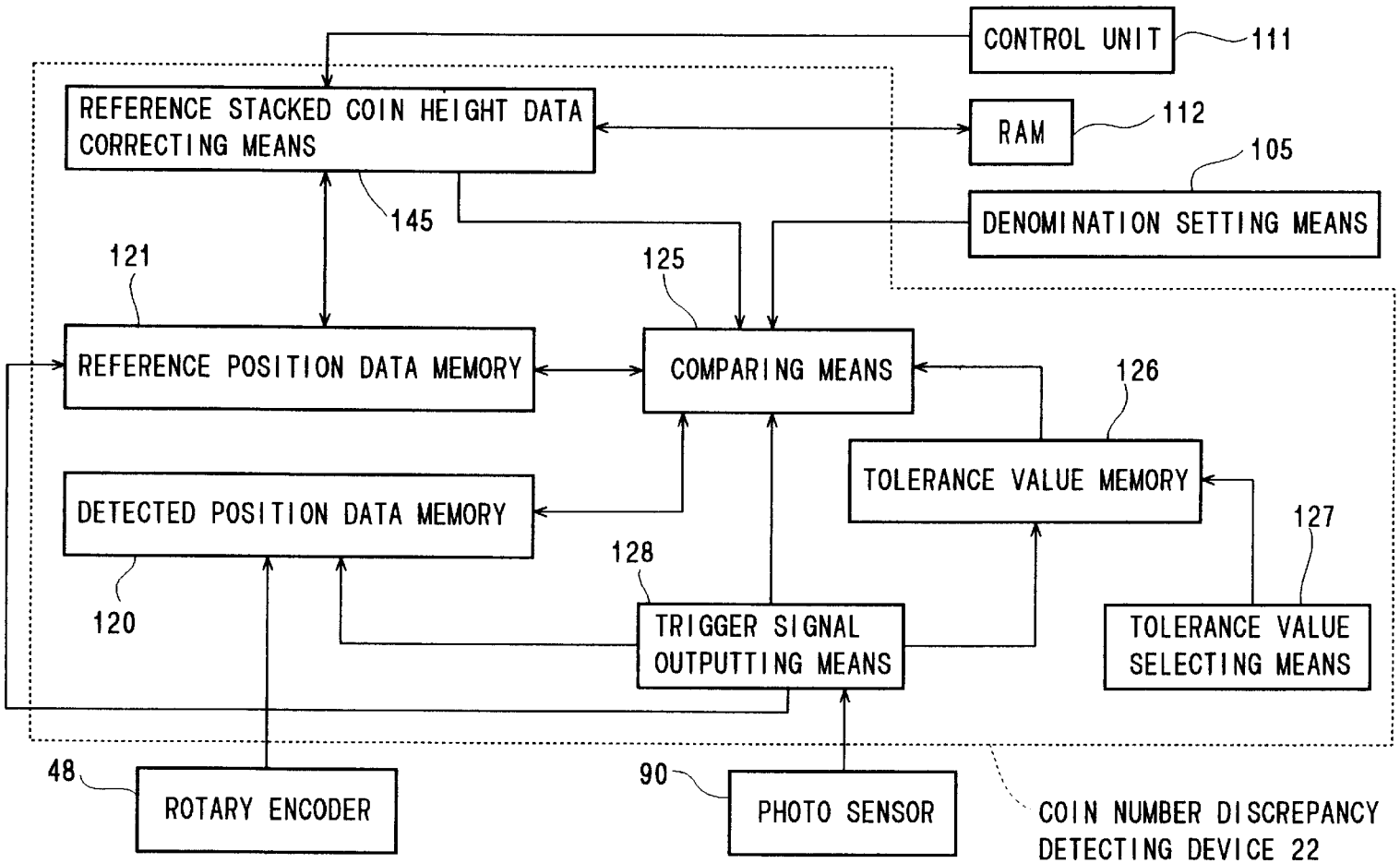
FIG. 7 is a block diagram of a coin number discrepancy detecting device provided in a coin wrapping machine which is a further preferred embodiment of the present invention.

FIG. 7 is a block diagram of a coin number discrepancy detecting device provided in a coin wrapping machine which is a further preferred embodiment of the present invention.

As shown in FIG. 7, in this embodiment, the coin number discrepancy detecting device 22 includes, instead of the reference stacked coin height data selecting means 140 in the embodiment shown in FIG. 6, a reference stacked coin height data correcting means 145 for correcting, in accordance with the number of new issue coins fed to the coin wrapping section 20 and the number of past issue circulating old coins fed to the coin wrapping section 20, the reference stacked coin height data stored in the reference position data memory 121 and outputting the thus corrected reference stacked coin height data to the comparing means 125, and has the same configuration as that in the embodiment shown in FIG. 6 except that the reference position data memory 121 stores the height of stacked coins formed by stacking N past issue circulating old coins of the same denomination as that of new issue coins as reference stacked coin height data.

More specifically, in the case where new issue coins and past issue circulating coins are wrapped without separating them, although the thickness of the new issue coin is equal to that of the past issue circulating old coin, since the surface pattern thereof is different from that of the past issue circulating coin, the height of stacked coins when a predetermined number of new issue coins are stacked or when the predetermined number of new issue coins and old coins are stacked is inevitably different from the height of stacked coins when the same number of past issue circulating old coins are stacked. Therefore, since the difference between the height of stacked coins when a predetermined number of only new issue coins are stacked and that when the predetermined number of past issue circulating old coins are stacked is generally small, even when new issue coins and past issue circulating coins of the same denomination as that of the new issue coins are wrapped together, it is possible to accurately detect whether the number of coins to be wrapped by the coin wrapping machine is more than or less than a predetermined number by storing the height of stacked coins when a predetermined past issue circulating old coins are stacked as the reference stacked coin height data in the reference position data memory 121, correcting, in accordance with the number of new issue coins and the number of past issue circulating coins included in a predetermined number of stacked coins, the reference stacked coin height data, outputting the thus corrected reference stacked coin height data to the comparing means 125 and causing the comparing means 125 to detect the discrepancy in the number of the stacked coins.

For example, the height of stacked coins when 50 new issue Japanese 500 yen coins are stacked is 92.9 mm and the height of stacked coins when 50 past issue circulating old Japanese 500 yen coins are stacked is 91.8 mm. Thus, the difference therebetween is only 1.1 mm and the thickness per coin is only from 1.836 mm to 1.858 mm. Therefore, if the height of stacked coins when 50 past issue circulating old 500 yen coins are stacked is stored as the reference stacked coin height data in the reference position data memory 121 and stacked coins are classified into three groups in accordance with the number of new issue 500 yen coins included in the stacked coins to be wrapped, it is possible to detect the discrepancy in the number of coins based on the reference stacked coin height data produced by stacking 50 past issue circulating old 500 yen coins or reference stacked coin height data obtained by correcting the reference stacked coin height data in accordance with the group of stacked coins to be wrapped.

Therefore, in this embodiment, the height of stacked coins 8 formed by stacking past issue circulating old coins of a number equal to the wrapping number N is stored as the reference stacked coin height data in the reference stacked coin height data 121 and in the case where N1 (N1 is a positive integer) or less, for example, 15 or less new issue coins are included among N stacked coins 8, for example, 50 coins, the reference stacked coin height data correcting means 145 classifies the stacked coins 8 into a first group, reads the reference stacked coin height data calculated based on old coins and stored in the reference position data memory 121 and outputs them to the comparing means 125 without correcting them. On the other hand, in the case where more than N1 and less than N2 (N2 is a positive integer greater than N1), for example, 16 to 34 new issue coins are included among N stacked coins 8, the reference stacked coin height data correcting means 145 classifies the stacked coins 8 into a second group, reads the reference stacked coin height data calculated based on old coins and stored in the reference position data memory 121, and corrects the reference stacked coin height data by subtracting a correction value corresponding to a unit rotation angle of the rotary encoder 48 from the thus read reference stacked coin height data when the thickness of the new issue coin is smaller than that of the past issue circulating old coin or corrects the reference stacked coin height data by adding a correction value corresponding to a unit rotation angle of the rotary encoder 48 to the thus read reference stacked coin height data when the thickness of the new issue coin is greater than that of the past issue circulating old coin and outputs the thus corrected reference stacked coin height data to the comparing means 125. Further, in the case where N2 or more, for example, 35 or more new issue coins are included among N stacked coins 8, the reference stacked coin height data correcting means 145 classifies the stacked coins 8 into a third group, reads the reference stacked coin height data calculated based on old coins and stored in the reference position data memory 121, and corrects the reference stacked coin height data by subtracting a correction value corresponding to double the unit rotation angle of the rotary encoder 48 from the thus read reference stacked coin height data when the thickness of the new issue coin is smaller than that of the past issue circulating old coin or corrects the reference stacked coin height data by adding a correction value corresponding to double the unit rotation angle of the rotary encoder 48 to the thus read reference stacked coin height data when the thickness of the new issue coin is greater than that of the past issue circulating old coin and outputs the thus corrected reference stacked coin height data to the comparing means 125.

In the case where coins of the denomination specified by the denomination setting means 105 include new issue coins and past issue circulating coins of the same denomination as that of the new issue coins, when the control unit 111 has detected coins to be wrapped of a number equal to the wrapping number N set by the wrapping number setting means 106, it immediately outputs a reference stacked coin height data correction signal to the reference stacked coin height data correcting means 145.

When the reference stacked coin height data correcting means 145 receives the reference stacked coin height data correction signal, it accesses the RAM 112 to read the counted number of the new issue coins to be wrapped and the counted number of the past issue circulating coins to be wrapped and judges whether or not the number of the new issue coins included in the stacked coins 8 is equal to or less than N1.

As a result, when the number of the new issue coins included in the stacked coins 8 is equal to or less than N1, the reference stacked coin height data correcting means 145 classifies the stacked coins 8 into a first group. In this case, the number of the new issue coins is few and since it is possible to detect the discrepancy in the number of coins using the reference stacked coin height data calculated based on the old coins and stored in the reference position data memory 121 without correcting them, the reference stacked coin height data correcting means 145 reads the reference stacked coin height data calculated based on the old coins and stored in the reference position data memory 121 and outputs them to the comparing means 125 without correcting them.

On the other hand, when the reference stacked coin height data correcting means 145 judges that the number of the new issue coins included in the stacked coins 8 exceeds N1, it further judges whether or not the number of the new issue coins included in the stacked coins 8 is less than N2.

As a result, when the reference stacked coin height data correcting means 145 judges that the number of the new issue coins included in the stacked coins 8 exceeds N1 and less than N2, it classifies the stacked coins 8 into a second group. In this case, since many new issue coins are included in the stacked coins 8, it is impossible to accurately detect the discrepancy in the number of coins unless the reference stacked coin height data calculated based on the old coins are corrected.

Therefore, the reference stacked coin height data correcting means 145 reads the reference stacked coin height data calculated based on the old coins and stored in the reference position data memory 121 and corrects them by subtracting a correction value corresponding to a unit rotation angle of the rotary encoder 48 from the thus read reference stacked coin height data when the thickness of the new issue coin is smaller than that of the past issue circulating old coin or corrects them by adding a correction value corresponding to a unit rotation angle of the rotary encoder 48 to the thus read reference stacked coin height data when the thickness of the new issue coin is greater than that of the past issue circulating old coin and outputs the thus corrected reference stacked coin height data to the comparing means 125.

On the other hand, when the reference stacked coin height data correcting means 145 judges that the number of the new issue coins included in the stacked coins 8 is equal to or more than N2, it classifies the stacked coins 8 into a third group. In this case, since the number of the new issue coins included in the stacked coins 8 is much greater than that included in the stacked coins 8 classified into in the second group, it is impossible to accurately detect the discrepancy in the number of coins unless the reference stacked coin height data calculated based on the old coins are greatly corrected.

Therefore, the reference stacked coin height data correcting means 145 reads the reference stacked coin height data calculated based on the old coins and stored in the reference position data memory 121 and corrects them by subtracting a correction value corresponding to double the unit rotation angle of the rotary encoder 48 from the thus read reference stacked coin height data when the thickness of the new issue coin is smaller than that of the past issue circulating old coin or corrects the reference stacked coin height data by adding a correction value corresponding to double the unit rotation angle of the rotary encoder 48 to the thus read reference stacked coin height data when the thickness of the new issue coin is greater than that of the past issue circulating old coin and outputs the thus corrected reference stacked coin height data to the comparing means 125.

On the other hand, when the trigger signal is input from the trigger signal outputting means 128, the comparing means 125 accesses the detected position data memory 120 to read the absolute position data output from the rotary encoder 48, accesses the tolerance value memory 126 to read the tolerance value, calculates the difference between the absolute position data read out from the detected position data memory 120 and the reference stacked coin height data input from the reference stacked coin height data selecting means 140, namely, the reference position data, and judges whether or not the absolute value of the difference is equal to or less than the tolerance value input from the tolerance value memory 126, thereby detecting the discrepancy in the number of the stacked coins 8.

According to this embodiment, in the case where the number of coins to be wrapped is N and coins to be wrapped include new issue coins and past issue circulating coins, the height of stacked coins formed by stacking N past issue circulating old coins are experimentally produced and stored in the reference position data memory 121 and the numbers of the new issue coins and the past issue circulating old coins which have been fed to the coin wrapping section 20 via the coin stacking section 6 based on the magnetic properties of coins detected by the magnetic sensor 100 and the optical properties of coins such as diameters, surface patterns, side surface patterns of coins and the like are counted by the control unit 111 and stored in the RAM 112. The reference stacked coin height data correcting means 145 accesses the RAM 112 to read the counted number of the new issue coins and the counted number of past issue circulating coins fed to the coin wrapping section 20 and classifies the stacked coins 8 in accordance with the thus read number of new issue coins and the number of past issue circulating old coins into the first group including N1 or less new issue coins, the second group including more than N1 and less than N2 new issue coins and the third group including N2 or more new issue coins. For the stacked coins 8 belonging to the first group, the reference stacked coin height data correcting means 145 reads the reference stacked coin height data calculated based on old coins and stored in the reference position data memory 121 and outputs them to the comparing means 125 without correcting them, thereby causing it to detect the discrepancy in the number of coins. For the stacked coins 8 belonging to the second group, the reference stacked coin height data correcting means 145 reads the reference stacked coin height data calculated based on old coins and stored in the reference position data memory 121 and corrects the reference stacked coin height data by subtracting a correction value corresponding to a unit rotation angle of the rotary encoder 48 from the thus read reference stacked coin height data when the thickness of the new issue coin is smaller than that of the past issue circulating old coin or corrects the reference stacked coin height data by adding a correction value corresponding to a unit rotation angle of the rotary encoder 48 to the thus read reference stacked coin height data when the thickness of the new issue coin is greater than that of the past issue circulating old coin and outputs the thus corrected reference stacked coin height data to the comparing means 125, thereby causing it to detect the discrepancy in the number of coins. For the stacked coins 8 belonging to the third group, the reference stacked coin height data correcting means 145 reads the reference stacked coin height data calculated based on old coins and stored in the reference position data memory 121 and corrects the reference stacked coin height data by subtracting a correction value corresponding to double the unit rotation angle of the rotary encoder 48 from the thus read reference stacked coin height data when the thickness of the new issue coin is smaller than that of the past issue circulating old coin or corrects the reference stacked coin height data by adding a correction value corresponding to double the unit rotation angle of the rotary encoder 48 to the thus read reference stacked coin height data when the thickness of the new issue coin is greater than that of the past issue circulating old coin and outputs the thus corrected reference stacked coin height data to the comparing means 125, thereby causing it to detect the discrepancy in the number of coins.

Therefore, according to this embodiment, even when new issue coins and past issue circulating coins of the same denomination as that of the new issue coins are wrapped together, it is possible to accurately detect whether the number of coins to be wrapped by the coin wrapping machine is more than or less than a predetermined number without need for great memory capacity and in a short calculating time.

Figure 8:
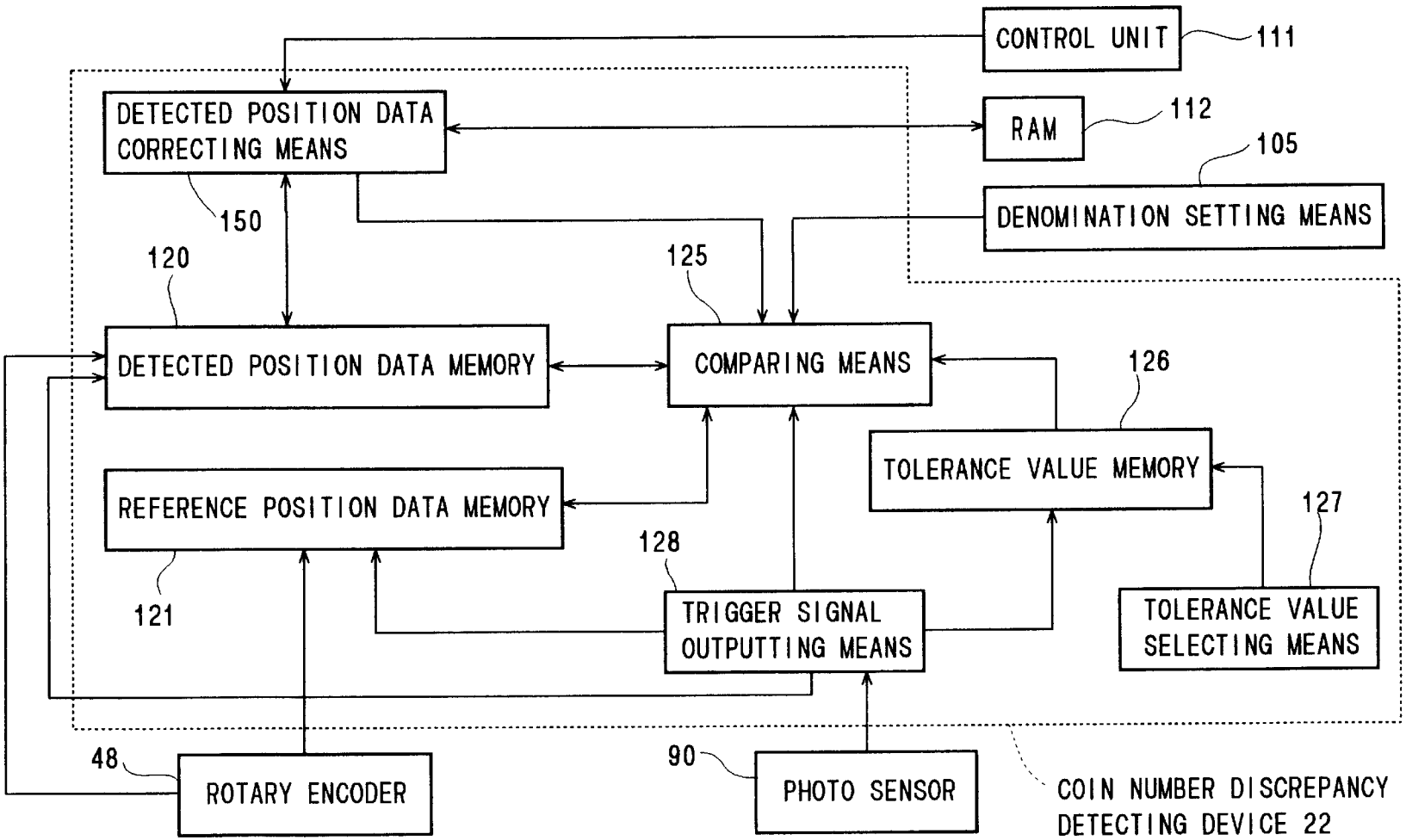
FIG. 8 is a block diagram of a coin number discrepancy detecting device provided in a coin wrapping machine which is a further preferred embodiment of the present invention.

FIG. 8 is a block diagram of a coin number discrepancy detecting device provided in a coin wrapping machine which is a further preferred embodiment of the present invention.

As shown in FIG. 8, in this embodiment, the coin number discrepancy detecting device 22 has the same configuration as that in the embodiment shown in FIG. 7 except that instead of the reference stacked coin height data correcting means 145 in the embodiment shown in FIG. 7, it includes a detected position data correcting means 150 for correcting absolute position data stored in the detected position data memory 120 in accordance with the number of new issue coins and the number of past issue circulating old coins fed to the coin wrapping section 20 and outputting the thus corrected absolute position data to the comparing means 125.

The detected position data correcting means 150 of the coin number discrepancy detecting device 22 according to this embodiment is constituted to access the RAM 112 to read the number of new issue coins and the number of past issue circulating old coins fed to the coin wrapping section 20 and classify the stacked coins 8 into a first group including N1 or less new issue coins, a second group including more than N1 and less than N2 new issue coins and a third group including N2 or more new issue coins. For the stacked coins 8 belonging to the first group, the detected position data correcting means 150 reads detected position data namely, detected absolute position data stored in the detected position data memory 120 and outputs them without correcting them, thereby causing it to detect the discrepancy in the number of coins. For the stacked coins 8 belonging to the second group, the detected position data correcting means 150 reads detected position data namely, detected absolute position data stored in the detected position data memory 120 and corrects the detected position data by subtracting a correction value corresponding to a unit rotation angle of the rotary encoder 48 from the thus read detected position data when the thickness of the new issue coin is greater than that of the past issue circulating old coin or corrects the detected position data by adding a correction value corresponding to a unit rotation angle of the rotary encoder 48 to the thus read detected position data when the thickness of the new issue coin is smaller than that of the past issue circulating old coin and outputs the thus corrected detected position data to the comparing means 125, thereby causing it to detect the discrepancy in the number of coins. For the stacked coins 8 belonging to the third group, the detected position data correcting means 150 reads detected position data namely, detected absolute position data stored in the detected position data memory 120 and corrects the detected position data by subtracting a correction value corresponding to double the unit rotation angle of the rotary encoder 48 from the thus read detected position data when the thickness of the new issue coin is greater than that of the past issue circulating old coin or corrects the detected position data by adding a correction value corresponding to double the unit rotation angle of the rotary encoder 48 to the thus read detected position data when the thickness of the new issue coin is smaller than hat of the past issue circulating old coin and outputs the thus corrected detected position data to the comparing means 125, thereby causing it to detect the discrepancy in the number of coins.

In the case where coins of the denomination specified by the denomination setting means 105 include new issue coins and past issue circulating coins of the same denomination as that of the new issue coins, when the control unit 111 has detected coins to be wrapped of a number equal to the wrapping number N set by the wrapping number setting means 106, it immediately outputs a detected position data correction signal to the detected position data correcting means 150.

When the detected position data correcting means 150 receives the detected position data correction signal, it accesses the RAM 112 to read the counted number of the new issue coins to be wrapped and the counted number of the past issue circulating coins to be wrapped and judges whether or not the number of the new issue coins included in the stacked coins 8 is equal to or less than N1.

When the number of the new issue coins included in the stacked coins 8 is equal to or less than N1, the detected position data correcting means 150 classifies the stacked coins 8 into a first group. In this case, the number of the new issue coins is few and since it is possible to detect the discrepancy in the number of coins by comparing the detected position data, namely, the absolute position data stored in the detected position data memory 120 with the reference stacked coin height data calculated based on the old coins and stored in the reference stacked coin height data memory 121 without correcting the detected position data, the detected position data correcting means 150 reads the detected position data stored in the detected position data memory 120 and outputs them to the comparing means 125 without correcting them.

On the other hand, when the detected position data correcting means 150 judges that the number of the new issue coins included in the stacked coins 8 exceeds N1, it further judges whether or not the number of the new issue coins included in the stacked coins 8 is less than N2.

As a result, when the detected position data correcting means 150 judges that the number of the new issue coins included in the stacked coins 8 exceeds N1 and is less than N2, it classifies the stacked coins 8 into a second group. In this case, since many new issue coins are included in the stacked coins 8, even if the detected position data, namely, the absolute position data stored in the detected position data memory 120 are compared with the reference stacked coin height data calculated based on the old coins and stored in the reference stacked coin height data memory 121 without correcting the detected position data, it is impossible to accurately detect the discrepancy in the number of stacked coins 8.

Therefore, the detected position data correcting means 150 reads the detected position data, namely, the absolute position data stored in the detected position data memory 120 and corrects the detected position data by subtracting a correction value corresponding to a unit rotation angle of the rotary encoder 48 from the thus read detected position data when the thickness of the new issue coin is greater than that of the past issue circulating old coin or corrects the detected position data by adding a correction value corresponding to a unit rotation angle of the rotary encoder 48 to the thus read detected position data when the thickness of the new issue coin is smaller than that of the past issue circulating old coin and outputs the thus corrected detected position data to the comparing means 125.

On the other hand, when the detected position data correcting means 150 judges that the number of the new issue coins included in the stacked coins 8 exceeds N2, it classifies the stacked coins 8 into a third group. In this case, since the number of the new issue coins included in the stacked coins 8 is much greater than that included in the stacked coins 8 classified into in the second group, it is impossible to accurately detect the discrepancy in the number of stacked coins 8 unless the detected position data are greatly corrected.

Therefore, the detected position data correcting means 150 reads the detected position data, namely, the absolute position data stored in the detected position data memory 120 and corrects the detected position data by subtracting a correction value corresponding to double the unit rotation angle of the rotary encoder 48 from the thus read detected position data when the thickness of the new issue coin is greater than that of the past issue circulating old coin or corrects the detected position data by adding a correction value corresponding to double the unit rotation angle of the rotary encoder 48 to the thus read detected position data when the thickness of the new issue coin is smaller than that of the past issue circulating old coin and outputs the thus corrected detected position data to the comparing means 125.

On the other hand, when the trigger signal is input from the trigger signal outputting means 128, the comparing means 125 accesses the reference position data memory 121 to read the reference stacked coin height data calculated based on the old coins, accesses the tolerance value memory 126 to read the tolerance value, calculates the difference between the detected position data, namely, the absolute position data input from the detected position data memory 120 and the reference stacked coin height data read out from the reference position data memory 120, and judges whether or not the absolute value of the difference is equal to or less than the tolerance value input from the tolerance value memory 126, thereby detecting the discrepancy in the number of the stacked coins 8.

According to this embodiment, in the case where the number of coins to be wrapped is N and coins to be wrapped include new issue coins and past issue circulating coins, the height of stacked coins formed by stacking N past issue circulating old coins is experimentally produced and stored in the reference position data memory 121 and the numbers of the new issue coins and the past issue circulating old coins which have been fed to the coin wrapping section 20 via the coin stacking section 6 based on the magnetic properties of coins detected by the magnetic sensor 100 and the optical properties of coins such as diameters, surface patterns, side surface patterns of coins and the like are counted by the control unit 111 and stored in the RAM 112. The detected position data correcting means 150 accesses the RAM 112 to read the counted number of the new issue coins and the counted number of past issue circulating coins fed to the coin wrapping section 20 and classifies the stacked coins 8 in accordance with the thus read number of new issue coins and the number of past issue circulating old coins into the first group including N1 or less new issue coins, the second group including more than N1 and less than N2 new issue coins and the third group including N2 or more new issue coins. For the stacked coins 8 belonging to the first group, the detected position data correcting means 150 reads detected position data namely, detected absolute position data stored in the detected position data memory 120 and outputs them without correcting them, thereby causing it to detect the discrepancy in the number of coins. For the stacked coins 8 belonging to the second group, the detected position data correcting means 150 reads detected position data namely, detected absolute position data stored in the detected position data memory 120 and corrects the detected position data by subtracting a correction value corresponding to a unit rotation angle of the rotary encoder 48 from the thus read detected position data when the thickness of the new issue coin is greater than that of the past issue circulating old coin or corrects the detected position data by adding a correction value corresponding to a unit rotation angle of the rotary encoder 48 to the thus read detected position data when the thickness of the new issue coin is smaller than that of the past issue circulating old coin and outputs the thus corrected detected position data to the comparing means 125, thereby causing it to detect the discrepancy in the number of coins. For the stacked coins 8 belonging to the third group, the detected position data correcting means 150 reads detected position data namely, detected absolute position data stored in the detected position data memory 120 and corrects the detected position data by subtracting a correction value corresponding to double the unit rotation angle of the rotary encoder 48 from the thus read detected position data when the thickness of the new issue coin is greater than that of the past issue circulating old coin or corrects the detected position data by adding a correction value corresponding to double the unit rotation angle of the rotary encoder 48 to the thus read detected position data when the thickness of the new issue coin is smaller than that of the past issue circulating old coin and outputs the thus corrected detected position data to the comparing means 125, thereby causing it to detect the discrepancy in the number of coins.

Therefore, according to this embodiment, even when new issue coins and past issue circulating coins of the same denomination as that of the new issue coins are wrapped together, it is possible to accurately detect whether the number of coins to be wrapped by the coin wrapping machine is more than or less than a predetermined number without need for great memory capacity and in a short calculating time.

The present invention has thus been shown and described with reference to a specific embodiment. However, it should be noted that the present invention is in no way limited to the details of the described arrangements but changes and modifications may be made without departing from the scope of the appended claims.

For example, in the embodiment shown in FIG. 6, reference stacked coin height data of stacked coins 8 formed by stacking (N−i) new issue coins and i past issue circulating old coins are experimentally produced in advance for each case of i=0 to N and stored in the reference position data memory 121 and the reference stacked coin height data selecting means 140 is constituted to access the RAM 112 to read the number of new issue coins fed to the coin wrapping section 20 and the number of past issue circulating old coins fed to the coin wrapping section 20, which are counted by the control unit 111, select, in accordance with the thus read number of new issue coins and the number of past issue circulating old coins, corresponding reference stacked coin height data from among reference stacked coin height data stored in the reference position data memory 121 and output them to the comparing means 125. However, similarly to the embodiment shown in FIG. 7, the reference stacked coin height data for each of groups of stacked coins 8 classified groups in accordance with the number of new issue coins and past issue circulating old coins included in the stacked coins 8 may be produced and stored in the reference position data memory 121 in advance and the reference stacked coin height data selecting means 140 may classify the stacked coins 8 into a plurality of groups in accordance with the number of new issue coins and past issue circulating old coins included in the stacked coins 8, read corresponding reference position data from the reference position data memory 121 and output them to the comparing means 125.

Further, in the embodiments shown in FIGS. 7 and 8, although the stacked coins 8 are classified into the first group including N1 or less new issue coins, the second group including more than N1 and less than N2 new issue coins and the third group including N2 or more new issue coins, the number of groups may be arbitrarily selected depending upon the difference between the height of stacked new issue coins and that of stacked past issue circulating coins and is not limited to three groups.

Moreover, in the embodiments shown in FIGS. 7 and 8, although the reference position data memory 121 is constituted to store the reference position data calculated based on past issue circulating old coins, the reference position data memory 121 may store reference position data calculated based on new issue coins instead of the reference position data calculated based on past issue circulating old coins. Further, the reference position data memory 121 may store an average value of the sum of the reference position data calculated based on past issue circulating old coins and the reference position data calculated based on new issue coins as the reference position data.

Further, in the above described embodiments, when the number of wrapped coins is more than or less than a predetermined number, the wrapping film 10 is cut by the cutter 96 and the coins are fed by the gate member 28 into the coin collecting box 27. Instead, however, the coins may be fed into the coin collecting box 27 without cutting the wrapping film 10 to be collected therein.

Furthermore, in the above described embodiments, the height of the stacked coins 8 is calculated by detecting the travel distances of the upper crimp claws 14 and the lower crimp claws 16 when they are moved toward each other based on the detection signal of the rotary encoder 48 connected to the rack 44 supported by the upper crimp claw arm 36 provided with the upper crimp claw 14 and the pinion 46 supported by the lower crimp claw arm 38 provided with the lower crimp claw 16. However, instead of such a mechanism, it is possible to provide a sensor for detecting the stacked coins when they are transferred from the coin stacking section 6 to the coin wrapping section 20 and detect the height of the stacked coins based on the time period during which the stacked coins are detected by the sensor and the moving speed of the stacked coins and the mechanism for calculating the height of stacked coins is not particularly limited.

Further, in the present invention, the respective means need not necessarily be physical means and arrangements whereby the functions of the respective means are accomplished by software fall within the scope of the present invention. In addition, the function of a single means may be accomplished by two or more physical means and the functions of two or more means may be accomplished by a single physical means.

According to the present invention, it is possible to provide a coin wrapping machine which can accurately detect whether the number of coins to be wrapped is more than or less than a predetermined number even in the case where new issue coins and past issue circulating coins of the same denomination are wrapped together.

What is claimed is:

1. A coin wrapping machine comprising a denomination specifying means for specifying a denomination of coins to be wrapped, a discriminating and counting means for discriminating whether or not a coin is acceptable, a denomination of the coin when the coin is acceptable and whether or not the denomination of the coin coincides with that specified by the denomination specifying means and counting coins of the denomination specified by the denomination specifying means, a coin stacking means for stacking coins of the denomination to be wrapped, a reference stacked coin height data storing means for storing reference stacked coin height data for each denomination of coins stacked by the coin stacking means, and a coin number discrepancy detecting device including a comparing means for comparing a height of stacked coins and the reference stacked coin height data for each denomination stored in the reference stacked coin height data storing means, the discriminating and counting means being made responsive to inclusion in coins of the denomination specified by the denomination specifying means of new issue coins and past issue circulating coins for discriminating whether each coin is a new issue coin or a past issue circulating coin, and the coin number and discrepancy detecting device being made responsive to inclusion in the coins of the denomination specified by the denomination specifying means of new issue coins and past issue circulating coins for causing the comparing means thereof to select the reference stacked coin height to be compared with the height of coins stacked by the coin stacking means in accordance with the number of the new issue coins and the number of the past issue circulating coins determined based on a count made by the discriminating and counting means.

2. A coin wrapping machine in accordance with claim 1 which further comprises a reference stacked coin height data producing means for producing the reference stacked coin height data in accordance with the number of the new issue coins and the number of the past issue circulating coins determined based on the count made by the discriminating and counting means.

3. A coin wrapping machine in accordance with claim 1 wherein the reference stacked coin height data storing means is constituted to store reference stacked coin height data of stacked coins formed by stacking (N−i) new issue coins and i past issue circulating old coins for each case of i=0 to N and which further comprises a reference stacked coin height data selecting means for selecting, when coins of the denomination specified by the denomination specifying means include new issue coins and past issue circulating coins, reference stacked coin height data from among the reference stacked coin height data stored in the reference stacked coin height data storing means in accordance with the number of the new issue coins and the number of the past issue circulating coins determined based on the count made by the discriminating and counting means and outputting the thus selected reference stacked coin height data to the comparing means.

4. A coin wrapping machine in accordance with claim 1 wherein coins of a denomination including the new issue coins and the past issue circulating coins and to be stacked by the coin stacking means are classified into a plurality of groups of a number less than the number of coins to be wrapped in accordance with the number of the new issue coins and the number of the past issue circulating coins, the reference stacked coin height data storing means is constituted to store reference stacked coin height data for each of the plurality of groups, and the reference stacked coin height data selecting means is constituted to classify the coins of a denomination including the new issue coins and the past issue circulating coins and to be stacked by the coin stacking means into a plurality of groups of a number less than the number of coins to be wrapped in accordance with the number of the new issue coins and the number of the past issue circulating coins determined based on the count made by the discriminating and counting means, select the reference stacked coin height data corresponding to each classified group and stored in the reference stacked coin height data storing means and output them to the comparing means.

5. A coin wrapping machine in accordance with claim 1 which further comprises a reference stacked coin height data correcting means for correcting, when coins of the denomination specified by the denomination specifying means include new issue coins and past issue circulating coins, the reference stacked coin height data stored in the reference stacked coin height data storing means in accordance with the number of the new issue coins and the number of the past issue circulating coins determined based on the count made by the discriminating and counting means, and outputting the thus corrected reference stacked coin height data to the comparing means.

6. A coin wrapping machine in accordance with claim 5 wherein the reference stacked coin height data correcting means is constituted to classify coins of a denomination including the new issue coins and the past issue circulating coins and stacked by the coin stacking means into a plurality of groups of a number less than the number of coins to be wrapped in accordance with the number of the new issue coins and the number of the past issue circulating coins determined based on the count made by the discriminating and counting means, correct the reference stacked coin height data stored in the reference stacked coin height data storing means in accordance with a correction value assigned to each of the groups, and output the thus corrected reference stacked coin height data to the comparing means.

7. A coin wrapping machine in accordance with claim 6 wherein the reference stacked coin height data storing means is constituted to store stacked coin height data produced by stacking the wrapped number of the past issue circulating coins as reference stacked coin height data of coins of a denomination including the new issue coins and the past issue circulating coins.

8. A coin wrapping machine in accordance with claim 6 wherein the reference stacked coin height data storing means is constituted to store stacked coin height data produced by stacking the wrapped number of the new issue coins as reference stacked coin height data of coins of denomination including the new issue coins and the past issue circulating coins.

9. A coin wrapping machine in accordance with claim 6 wherein the reference stacked coin height data storing means is constituted so as to store an average value of stacked coin height data produced by stacking the wrapped number of the new issue coins and stacked coin height data produced by stacking the wrapped number of the past issue circulating coins as reference stacked coin height data of coins of denomination including the new issue coins and the past issue circulating coins.

10. A coin wrapping machine in accordance with claim 5 wherein the reference stacked coin height data storing means is constituted to store stacked coin height data produced by stacking the wrapped number of the past issue circulating coins as reference stacked coin height data of coins of a denomination including the new issue coins and the past issue circulating coins.

11. A coin wrapping machine in accordance with claim 5 wherein the reference stacked coin height data storing means is constituted to store stacked coin height data produced by stacking the wrapped number of the new issue coins as reference stacked coin height data of coins of denomination including the new issue coins and the past issue circulating coins.

12. A coin wrapping machine in accordance with claim 5 wherein the reference stacked coin height data storing means is constituted so as to store an average value of stacked coin height data produced by stacking the wrapped number of the new issue coins and stacked coin height data produced by stacking the wrapped number of the past issue circulating coins as reference stacked coin height data of coins of denomination including the new issue coins and the past issue circulating coins.

13. A coin wrapping machine comprising a denomination specifying means for specifying a denomination of coins to be wrapped, a discriminating and counting means for discriminating whether or not a coin is acceptable, a denomination of the coin when the coin is acceptable and whether or not the denomination of the coin coincides with that specified by the denomination specifying means and counting coins of the denomination specified by the denomination specifying means, a coin stacking means for stacking coins of the denomination to be wrapped, a reference stacked coin height data storing means for storing reference stacked coin height data for each denomination of coins stacked by the coin stacking means, a detected stacked coin height data storing means for storing a height of coins stacked by the coin stacking means, a detected stacked coin height data correcting means for correcting the detected stacked coin height data stored in the detected stacked coin height data storing means, and a coin number discrepancy detecting device including a comparing means for comparing the height of coins stacked by the coin stacking means and stored in the detected stacked coin height data storing means and the reference stacked coin height data for each denomination stored in the reference stacked coin height data storing means, the discriminating and counting means being made responsive to inclusion coins of the denomination specified by the denomination specifying means of new issue coins and past issue circulating coins for discriminating whether the coin is a new issue coin or a past issue circulating coin and the detected stacked coin height data correcting means being made responsive to inclusion in the coins of the denomination specified by the denomination specifying means for correcting the detected stacked coin height data stored in the detected stacked coin height data storing means in accordance with the number of the new issue coins and the number of the past issue circulating coins determined based on a count made by the discriminating and counting means, and outputting the thus corrected detected stacked coin height data to the comparing means.

14. A coin wrapping machine in accordance with claim 13 wherein the detected stacked coin height data correcting means is constituted to classify the coins of a denomination including the new issue coins and the past issue circulating coins and stacked by the coin stacking means into a plurality of groups of a number less than the number of coins to be wrapped in accordance with the number of the new issue coins and the number of the past issue circulating coins determined based on the count made by the discriminating and counting means, correct the detected stacked coin height data stored in the detected stacked coin height data storing means in accordance with a correction value assigned to each of the groups, and output the thus corrected reference stacked coin height data to the comparing means.

15. A coin wrapping machine in accordance with claim 14 wherein the detected stacked coin height data correcting means is constituted to store stacked coin height data produced by stacking the wrapped number of the past issue circulating coins as reference stacked coin height data of coins of denomination including the new issue coins and the past issue circulating coins.

16. A coin wrapping machine in accordance with claim 14 wherein the detected stacked coin height data correcting means is constituted to store stacked coin height data produced by stacking the wrapped number of the new issue coins as reference stacked coin height data of coins of denomination including the new issue coins and the past issue circulating coins.

17. A coin wrapping machine in accordance with claim 14 wherein the detected stacked coin height data correcting means is constituted to store an average value of stacked coin height data produced by stacking the wrapped number of the new issue coins and stacked coin height data produced by stacking the wrapped number of the past issue circulating coins as reference stacked coin height data of coins of denomination including the new issue coins and the past issue circulating coins.

18. A coin wrapping machine in accordance with claim 13 wherein the detected stacked coin height data correcting means is constituted to store stacked coin height data produced by stacking the wrapped number of the past issue circulating coins as reference stacked coin height data of coins of denomination including the new issue coins and the past issue circulating coins.

19. A coin wrapping machine in accordance with claim 13 wherein the detected stacked coin height data correcting means is constituted to store stacked coin height data produced by stacking the wrapped number of the new issue coins as reference stacked coin height data of coins of denomination including the new issue coins and the past issue circulating coins.

20. A coin wrapping machine in accordance with claim 13 wherein the detected stacked coin height data correcting means is constituted to store an average value of stacked coin height data produced by stacking the wrapped number of the new issue coins and stacked coin height data produced by stacking the wrapped number of the past issue circulating coins as reference stacked coin height data of coins of denomination including the new issue coins and the past issue circulating coins.

* * * * *